US010829286B2

(12) United States Patent
Murray et al.

(10) Patent No.: US 10,829,286 B2
(45) Date of Patent: Nov. 10, 2020

(54) SPOUTED POUCH ADAPTED TO BE FILLED WITH A FLOWABLE PRODUCT AND METHOD OF PRODUCTION THEREOF

(71) Applicant: Scholle IPN IP B.V., SX Tilburg (NL)

(72) Inventors: Christopher John Murray, Chicago, IL (US); Jeroen Pieter Fiere, 's-Gravendeel (NL); Chad Mueller, Aurora, IL (US); David Bellmore, DeWitt, MI (US)

(73) Assignee: Scholle IPN IP BV, Tilburg (NL)

( * ) Notice: Subject to any disclaimer, the term of this patent is extended or adjusted under 35 U.S.C. 154(b) by 174 days.

(21) Appl. No.: 15/761,667

(22) PCT Filed: Sep. 21, 2016

(86) PCT No.: PCT/NL2016/050646
§ 371 (c)(1),
(2) Date: Mar. 20, 2018

(87) PCT Pub. No.: WO2017/052364
PCT Pub. Date: Mar. 30, 2017

(65) Prior Publication Data

US 2018/0346219 A1 Dec. 6, 2018

(30) Foreign Application Priority Data

Sep. 21, 2015 (NL) ..... 2015473

(51) Int. Cl.

| | |
|---|---|
| ***B65D 75/58*** | (2006.01) |
| ***B65B 55/02*** | (2006.01) |
| ***B65B 55/08*** | (2006.01) |
| ***B65D 41/34*** | (2006.01) |
| ***B65B 3/04*** | (2006.01) |
| ***B65B 7/16*** | (2006.01) |
| ***B65D 51/18*** | (2006.01) |
| ***B65B 43/26*** | (2006.01) |

(Continued)

(52) U.S. Cl.
CPC ..... *B65D 75/5883* (2013.01); *B65B 3/045* (2013.01); *B65B 7/168* (2013.01);
(Continued)

(58) Field of Classification Search
CPC ..... B65D 75/5883; B65D 75/008; B65D 41/3409; B65D 51/18; B65D 2101/0046;
(Continued)

(56) References Cited

U.S. PATENT DOCUMENTS 2,969,792 A * 1/1961 Milton ..... A61M 3/0245 604/90
3,730,240 A * 5/1973 Presnick ..... B65D 81/052 383/3

(Continued)

FOREIGN PATENT DOCUMENTS

DE 29801270 U1 2/1998
DE 102007011929 A1 9/2008

(Continued)

*Primary Examiner* — Kareen K Thomas
(74) *Attorney, Agent, or Firm* — The Watson IP Group, PLC; Jovan N. Jovanovic

(57) ABSTRACT

In combination a spouted pouch (1) to be filled with a flowable product by a filling machine, a plug (50), and a cap (70). The interference fit plug is releasably mounted over the top end of the neck of the spout body and hermetically seals the product passage of the spout body. The plug is adapted to be removed by the filling machine and to be replaced by pressing the plug onto the neck after filling of the pouch. The plug removal, filling, and replacing of the plug are preferably performed in an aseptic environment. The cap is after the filling of the pouch and the replacing of the plug onto the neck. The capping is preferably performed by a capping machine in a non-aseptic environment.

13 Claims, 23 Drawing Sheets

Figure 1:
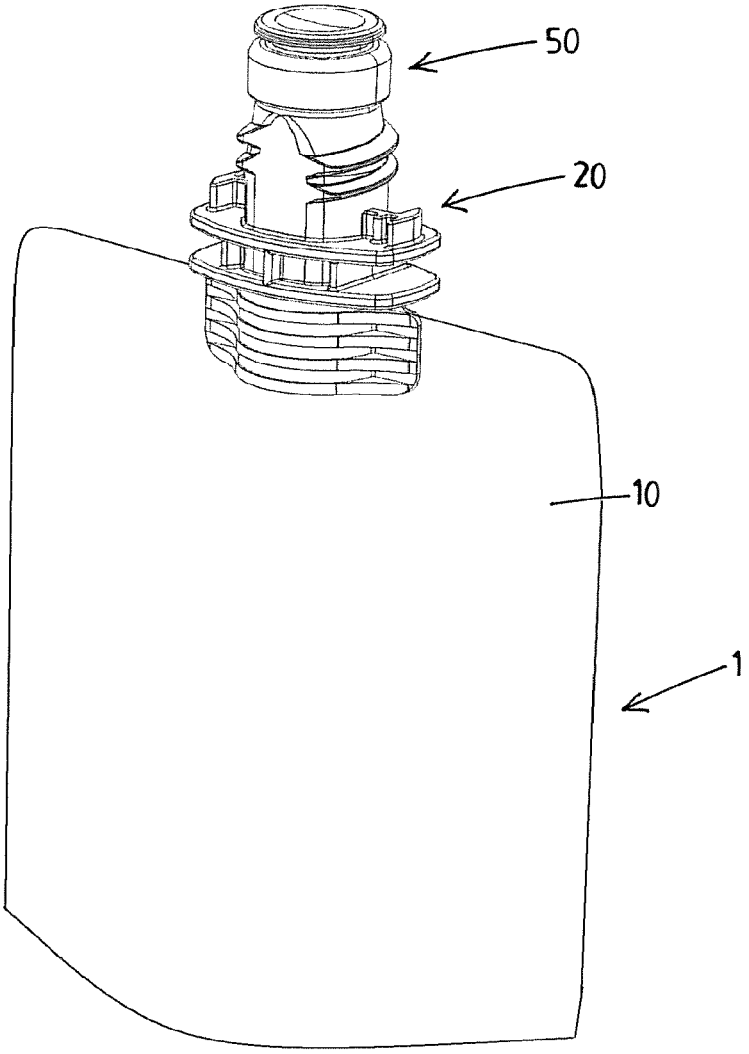

(51) Int. Cl.
*B65D 75/00* (2006.01)
*B65B 55/10* (2006.01)

(52) U.S. Cl.
CPC ..... *B65B 43/26* (2013.01); *B65B 55/022* (2013.01); *B65B 55/025* (2013.01); *B65B 55/027* (2013.01); *B65B 55/08* (2013.01); *B65D 41/3409* (2013.01); *B65D 51/18* (2013.01); *B65D 75/008* (2013.01); *B65B 55/10* (2013.01); *B65D 2251/0015* (2013.01); *B65D 2251/0075* (2013.01); *B65D 2401/30* (2020.05)

(58) Field of Classification Search
CPC .... B65D 2251/0015; B65D 2251/0075; B65D 33/001; B65D 33/002; B65D 33/005; B65D 33/007; B65D 33/10; B65D 33/16; B65D 33/1608; B65D 33/165; B65B 43/26; B65B 55/022; B65B 55/025; B65B 55/027; B65B 55/08; B65B 3/045; B65B 7/168; B65B 55/10
USPC ..... 215/355, 50, 294, 296, 299, 300, 320; 383/210, 43, 44, 61.1, 80, 96
See application file for complete search history.

(56) References Cited

U.S. PATENT DOCUMENTS 3,915,212 A * 10/1975 Bujan ..... A61J 1/10 604/408
4,396,383 A * 8/1983 Hart ..... A61J 1/2093 604/404
4,550,825 A * 11/1985 Sutryn ..... A61J 1/2089 206/219
4,614,267 A * 9/1986 Larkin ..... A61J 1/2089 206/219
4,784,658 A * 11/1988 Grabenkort ..... A61J 1/2089 604/410
4,936,445 A * 6/1990 Grabenkort ..... A61J 1/2089 206/219
6,854,888 B1 * 2/2005 Brown ..... A45F 3/20 222/107
9,073,685 B2 * 7/2015 Ray ..... B65D 83/0094
9,821,284 B2 * 11/2017 Johns ..... B65D 75/5883
2005/0045242 A1 3/2005 Osborne
2007/0012644 A1 1/2007 Uytterhaeghe et al.
2008/0135513 A1 * 6/2008 Umenaka ..... B65D 41/3409 215/252
2011/0132941 A1 6/2011 Kim
2015/0147430 A1 5/2015 Dzikowicz et al.

FOREIGN PATENT DOCUMENTS

EP 1980498 A1 10/2008
EP 2399841 A1 12/2011
WO 03022314 A2 3/2003
WO 2004060762 A1 7/2004
WO 20121292885 A1 10/2012
WO 2014007612 A1 1/2014
WO 2014027602 A1 2/2014
WO 2014171834 A2 10/2014

* cited by examiner

SPOUTED POUCH ADAPTED TO BE FILLED WITH A FLOWABLE PRODUCT AND METHOD OF PRODUCTION THEREOF

The present invention relates to the field of filling of spouted pouches or other containers with a flowable product.

In a known approach spouted pouches are manufactured without a cap and supplied to a filling and capping machine where the pouches are filled and where a cap is assembled onto the neck of the spout. Often manually openable screw caps are employed to close the pouch.

For example WO2014171834 discloses to collect spouted pouches in transport rails. It is disclosed that, after the filling, the spouted pouches are sealed by a cap. It is disclosed that it is conceivable that the spouted pouches are provided with caps before they are transported to the filling machine, where the caps are removed prior to the filling process and then replaced after filling. As an alternative it is disclosed that the caps are supplied to the filling machine, independent of the spouted pouches.

The flowable products that are stored in spouted pouches may e.g. be foodstuffs, which may place stringent demands on aseptic handling and sealing of the filled spouted pouches.

The present invention aims to provide a cost effective solution for the production of filled spouted pouches, in particular of aseptically filled spouted pouches.

It is a further aim of the present invention to provide measures that allow for high-speed filling of spouted pouches, in particular in an aseptic environment.

It is a further aim of the present invention to provide measures that allow for high-speed filling of spouted pouches, with the integrity of the sealing of the spouted pouch not impaired by high-speed operation of the filling machine and/or lower demands being placed on the design/operation of the filling machine.

The present invention aims to provide a cost effective solution for the production of filled spouted pouches, in particular of aseptically filled spouted pouches, which, in embodiments, also offers to possibility for easy inline control of whether or not the assembly process has been performed in a correct manner.

In view of one or more of the aims outlined above the invention provides a combination of a spouted pouch that is adapted to be filled with a flowable product by a filling machine, a plug, and a cap, as described in claim 1.

The inventive solution allows for the production of aseptically filled pouches, wherein the user openable cap does not need to be subjected to any sterilizing process. As is preferred, the plug removal, the filling of the pouch with the flowable product, and replacing of the plug are performed in an aseptic environment, whereas the assembly of the cap is preferably done in a non-aseptic environment, e.g. by a capping machine downstream of the filling machine. This approach is possible as the plug hermetically reseals the filled pouch prior to leaving the aseptic environment.

In a preferred embodiment an aseptic environment is created wherein there is a positive flow of sterilized gas, e.g. of sterilized air. For example the environment is created within a chamber housing the filling machine or a part thereof.

It will be appreciated that the combination of claim 1 can also be used in processes where the placement of the cap does take place within the aseptic environment. This will however demand the sterilization of the cap.

The plug of claim 1 seals on the exterior of the neck. In combination with a suitable filling machine, in particular nozzle thereof, one can achieve the effect that this sealing takes place on a surface of the neck that has not been in contact with the flowable product. Thereby a high quality seal is enhanced. Moreover, in an embodiment of the filling machine, e.g. of the filling nozzle, the filling machine has not touched the sealing surface of the neck where the outer wall of the plug seals onto the neck, so avoiding any chance of this neck sealing surface being scratched or damaged by the filling nozzle or filling machine. For example the nozzle extends into the neck and/or seals onto the top end of the neck, without the filling nozzle touching this external sealing surface for the plug. In another embodiment the filling nozzle may touch the exterior sealing surface of the neck, e.g. with the nozzle sealing onto the very top end of the neck. The latter embodiment may pose additional requirements on the contact face of the nozzle, e.g. the smoothness thereof, and/or on the positioning of the neck relative to the nozzle.

In an embodiment the still empty spouted pouch closed by the plug, yet without the cap being assembled, is or has been subjected to a pre-sterilizing treatment prior to entry into the aseptic environment. For example the empty spouted pouch has been sterilized in said closed condition by means of suitable irradiation which has the benefit of sterilizing the inside of the pouch as well. Other sterilization treatments, e.g. externally spraying of a sterilant medium on the spouted pouch, are also possible. Upon entry into the filling machine, for example, the outside of the pre-sterilized, e.g. irradiated, pouch and spout may be treated in a tunnel with sterilant vapour, e.g. hydrogen peroxide, before entering an aseptic chamber of the filling machine where the removal of the plug, filling, and replacement of the plug are performed.

For example spouted pouches provided with plugs fitted onto the neck are collected on intermediate transport rails, e.g. multiple filled transport rails being stored in a packaging, and the entirety being subjected to a radiation treatment to sterilize the empty pouches. The plugs seal the pouches and thereby guarantee that the pouch and the neck, including the top end of the exterior thereof, remain sterile.

It is noted that whilst the invention is primarily advantageous for aseptic applications, e.g. for certain foodstuffs or beverages, it may also be used in non-aseptic filling applications.

The pouch may e.g. be made of a multilayer film, e.g. including one or more metal or metallized layers, e.g. coextruded or laminated.

The pouch may e.g. be composed of two pouch panels or walls that are sealed along their edges. For example the pouch is provided with a bottom gusset structure, e.g. embodied to allow the filled pouch to stand on its bottom. Other pouch designs are also possible.

The pouch may e.g. have a volume to be filled with the flowable product between 0.1 and 0.5 litre, however other volumes are also possible.

In an embodiment the plug body comprises one or more centering portions downwardly depending from the top portion of the plug body and frictionally engaging the interior surface of the neck when the plug is mounted over the top end of the neck.

In an embodiment the plug body is provided with a number of posts or stubs that depend downward from the top portion, e.g. a circular array of posts, e.g. three or more posts on a circle.

In an embodiment the centering portion of the plug body comprises, preferably is formed by, an inner annular wall downwardly depending from the top portion of the plug body and coaxial with the outer annular wall, wherein the inner annular wall frictionally engages the interior surface of the neck when the plug is mounted over the top end of the neck, wherein the inner and outer annular wall of the plug body define an open bottomed annular groove between them in which the top end of the neck is received when the plug is mounted over the top end of the neck. As will be elucidated in more detail below, this embodiment e.g. allows to park the plug temporarily on a pin portion of a plug retention member of the filling machine during the actual filling of the pouch. The pin portion stays clear of the annular sealing surface of the outer wall of the plug, so that even at high speeds there is no risk of said delicate sealing surface becoming scratched by the plug retention member which would otherwise impair the sealing quality.

In an embodiment the one or more centering portions, e.g. the inner annular wall, extend downward beyond the outer annular wall, e.g. said one or more centering portions having a bevelled lower edge to facilitate introduction of the one or more centering portions into the neck of the spout body. This allows to properly center the plug relative to the neck prior to the outer wall with the delicate sealing surface thereof contacting the neck of the spout. This is beneficial in view of high-speed operation of the filling machine, and reduces demands on the exact positioning of the spout relative to the filling machine. The inner annular wall may have a bevelled edge on the outside to enhance introduction into the neck of the spout, and a bevelled edge on the inside to enhance placing the plug over a pin portion of the plug retention member.

In an embodiment the top portion of the plug body is provided with a peripheral groove extending around the top portion, preferably a single peripheral groove. For example this groove is adapted to allow for coupling of a plug removal and/or replacement device or devices of the filling machine to the plug. As will be elucidated below the same groove may also serve in the context of snap fitting of the cap onto the plug. In another embodiment distinct grooves are provided for the two functions. It is preferred for the one or more peripheral grooves to be arranged on the top portion and not on the outer annular wall in view of the desire to handle the outer wall, which forms the seal, with great care. For example the high-speed operating plug removal device may engage on the groove in the top portion without detrimental impact on the shape of the outer wall, e.g. as the top portion is more robust than the outer annular wall.

In an embodiment the inner annular wall of the plug body, when present, is provided on an exterior surface thereof with a relief formed by alternating ribs and grooves with said ribs frictionally engaging the interior surface of the neck. For example these ribs and grooves extend axially. The ribs, in suitable dimensioning, may enhance the frictional engagement with the interior of the neck, e.g. to avoid any risk of loss of the plug from the spout. Preferably the ribs and grooves are such that there is no seal between the interior surface of the neck and the inner wall of the plug. For example the passages formed between the grooves avoid a pressure built up between the plug and the neck as the plug is pressed over the neck. For example the ribs are bevelled at their lower end enhancing introduction into the neck of the spout.

In an embodiment each snap-fit formation of the plug body is embodied by the top portion of the plug body. This design focuses any stresses induced by the snap-fit between the cap and the plug in the top portion of the plug body, thus keeping the outer annular wall basically free of such stresses and thus avoiding undue impact on seal quality provided by the outer annular wall.

In an embodiment the top portion of the plug body is provided with a peripheral groove extending around the top portion, wherein an upper shoulder of the plug body delimits the top of the peripheral groove, and wherein one or more snap-fit formations of the cap extend into said peripheral groove and engage underneath said upper shoulder of the plug body. As explained the same groove may be used to engage a suitable plug removal and/or replacement device of the filling machine with the plug.

In an embodiment the first and second cap connector formations are integrally molded threads.

In another embodiment the first and second cap connector formations are embodied to form a snap-fit connection between the cap and the neck of the spout. For example the neck is provided with a peripheral snap bead on its exterior and the cap with a mating peripheral snap bead, or snap bosses, at its interior with the latter engaging underneath the former. Other snap arrangements are also possible.

In yet another embodiment the first and second cap connector formations are embodied to form a bayonet type connector.

In an embodiment wherein the first and second cap connector formations are integrally molded threads it is envisaged that the outer diameter of the outer annular wall of the plug body is less than the minor diameter of the thread on the tubular neck and that the inner diameter of the thread on the cap is greater than the outer diameter of the outer annular wall of the plug body This allows to lower of the cap over the plug without the thread of the cap touching or at least placing any undue load on the outer wall of the plug, thereby preserving the integrity of the shape and sealing quality of the outer annular wall.

In an embodiment the cap body comprises one or more windows, preferably integrally molded, that display one or more sections of the plug body when coupled to the cap body. For example in an embodiment according to claim 7 the cap body comprises one or more windows that display said upper shoulder of the plug body when the plug body is coupled to the cap body. Displaying through the one or more windows one or more sections of the plug body e.g. allows for efficient inline checking of whether the plug body is actually present under the cap after completion of the assembly. So it allows for a simple final check of the integrity of the closure of the filled pouch. Also, in an embodiment, different colours may be used for the cap and the plug, with the window(s) offering the possibility to create a desirable appearance.

In an embodiment the spout body comprises a pair of upper and lower flanges extending around the neck, below said first cap connector formation, e.g. below a first thread on the neck. As is known in the field such flanges may be used in the course of conveyance of the spouted pouches, e.g. through the filling machine, e.g. with the neck passing between parallel rails or other guide members with parts of the upper flanges above and parts of the lower flanges below two parallel rails or other guide members. As disclosed in WO2014171834 these flanges may also be used to keep the spouted pouches in intermediate transportation rails that are used for transportation of empty spouted pouches to a remote filling machine or a remote filling plant.

In an embodiment, as known in the field, a portion of the neck intermediate said upper and lower flanges is provided with a pair of parallel vertical guide faces at diametrically opposed locations, e.g. allowing for guiding of the neck in a guide slot of the filling machine.

In an embodiment the cap is dimensioned such that the tamper-evident structure at the lower end of the skirt of the cap body is located directly above the upper flange when the cap is assembled on the spouted pouch.

In an embodiment the tamper-evident structure on the cap body and the mating tamper-evident formations on the spout body are embodied as disclosed in WO2014007612 which is incorporated herein by reference.

In an embodiment the cap body comprises a top wall with an outer perimeter, wherein the skirt of the cap depends downward from this outer perimeter. The cap body is provided with one or more windows.

In an embodiment the one or more windows are embodied as one or more elongates slots in circumferential direction, e.g. in the skirt directly below the top wall.

For example the one or more windows solely offer a view on the top section of the plug and do not offer a view onto the outer annular wall of the plug.

In another embodiment one or more windows could be present in the top wall, yet in a preferred embodiment the top wall is solid and covers the plug entirely from above and lacks any windows offering a view or access to the plug from above.

The interior of the skirt in an embodiment comprises a peripheral snap-fit ledge protruding inward, which ledge engages beneath a peripheral shoulder of the cap body, e.g. said ledge delimits the lower edge of the one or more windows, e.g. of the elongated slotted windows. This embodiment allows for retention of the plug body at its top portion, thereby avoiding snap-fit stresses on the outer annular wall. The snap-fit can be checked via the one or more windows. If the plug body would not reach its ultimate position in the cap body this would be visible via the one or more windows, in particular when designed as elongated slot directly below the top wall.

In an embodiment the top wall of the cap covers the entirety of the top face of the plug, so that no access is available to the plug from above.

In an embodiment the cap body comprises a top wall with an outer perimeter, wherein said skirt depends downward from said outer perimeter, and wherein the cap body comprises a vertical panel extending in a vertical center plane of the cap body and extending over said top wall and along the exterior of the skirt, thereby strengthening the cap body and enhancing grip by the user. The strengthening may be of advantage in view of the snap-fit between the cap and the plug body, which should remain intact when the user opens the spouted pouch. The panel may also be dimensioned so as to provide a choke hazard proof design, as shown here. For example the cap does not fit into the EN71-1 choke hazard test cylinder.

In another embodiment the integrally molded cap body comprises an annular gripping wall generally concentric with the skirt and spaced radially around the skirt, with one or more web portions connecting the annular gripping wall to the skirt. An example thereof is disclosed in WO2014007612. For example the cap with integral gripping wall does not fit into the EN71-1 choke hazard test cylinder.

The invention, in an embodiment, also relates to the combination of a spouted pouch that is adapted to be aseptically filled with a flowable product by a filling machine and a cap, wherein said combination includes a spouted pouch comprising:

a flexible material pouch body, a spout having an molded spout body of plastic material, said spout body having at a lower end thereof an attachment portion that is attached to the pouch body, wherein said spout body has at an upper end thereof a tubular neck, which neck has an interior surface delimiting at least a section of a product passage that extends from a lower product passage opening through the spout body to a mouth opening at a top end of the neck, said neck also having an exterior surface, an interference-fit plug that is releasably mounted over the top end of the neck of the spout body in an interference fit and which hermetically seals the product passage of the spout body, which plug has an molded plug body of plastic material, wherein the plug body has a top portion and downward depending concentric inner and outer annular walls that define between them an open bottomed annular space, wherein a top section of the tubular neck of the spout is received in said annular space of the plug body, wherein the outer annular wall has an interior surface which embodies an annular sealing surface, e.g. in inward protruding seal bead, and wherein the exterior surface of the top section of the neck embodies a cooperating annular sealing surface such that a hermetic seal is present between the outer annular wall of the plug and the neck of the spout body, wherein the inner annular wall is dimensioned to fit in the tubular neck, wherein the exterior of the neck of the spout body, below the top section thereof, is provided with an integrally molded thread, said thread having a minor diameter, and wherein the outer diameter of the outer annular wall of the plug body is less than the minor diameter of the thread on the tubular neck, wherein the plug is adapted to be removed by the filling machine and to be replaced by pressing the plug onto the neck after aseptic filling of the pouch with the flowable product, wherein said plug removal, filling, and replacing of the plug are preferably performed in a aseptic environment, wherein said combination further includes a manually openable rotational cap that is adapted to be assembled on the spouted pouch after the aseptic filling of the pouch and the replacing of the plug onto the neck, wherein the cap has a cap body that is injection molded of thermoplastic material, which cap body includes an annular skirt having an interior surface, an exterior surface, and a lower end, wherein a section of the interior of the skirt is provided with an integrally molded thread that cooperates with said integrally molded thread on the neck of the spout body, and wherein the cap and the plug are provided with cooperating snap-fit formations, such that the cap can be screwed or press-fitted on the spout body whilst the plug is mounted on the neck of the spout body with said snap-fit formations engaging to couple the plug to the cap such that upon rotation of the cap in opening direction the plug remains coupled to the cap and is entrained with the cap so as to open the product passage and allow dispensing of the flowable product from the filled pouch, and wherein the cap, below the skirt, is provided with an integrally molded tamper-evident structure that allows to visually evidence the first time opening of the filled pouch, and wherein the spout body, below the thread thereon, is provided with one or more integrally molded formations that cooperate with said tamper-evident structure of the cap, such that upon first time opening of the filled pouch the tamper-evident structure evidences said first time opening, e.g. as one or more breakable bridges in said structure break upon rotation of the cap in opening direction for the first time.

The invention also relates to a method for production of aseptically filled spouted pouches with a manually openable cap, which method comprises:

supplying an empty, preferably pre-sterilized, spouted pouch to a filling machine, which spouted pouch comprises:

a flexible material pouch body, a spout having a molded spout body of plastic material, said spout body having at a lower end thereof an attachment portion that is attached to the pouch body, wherein said spout body has at an upper end thereof a tubular neck, which neck has an interior surface delimiting at least a section of a product passage that extends from a lower product passage opening through the spout body to a mouth opening at a top end of the neck, said neck also having an exterior surface, an interference-fit plug, wherein the plug is releasably mounted onto, e.g. over or into, the top end of the neck of the spout body and hermetically seals the product passage of the spout body, which plug has a molded plug body of plastic material, wherein the plug body has a top portion and a downward depending annular wall, e.g. an outer annular wall, adapted to be fitted onto a top section of the tubular neck of the spout, wherein the annular wall of the plug body has a surface which embodies an annular sealing surface, e.g. an inwardly or outwardly protruding seal bead, and wherein a surface of the top section of the neck embodies a cooperating annular sealing surface such that a hermetic seal is present between the annular wall of the plug and the neck of the spout body, wherein the exterior of the neck of the spout body, below the top section thereof, is provided with an integrally molded first cap connector formation, wherein the plug is adapted to be removed by the filling machine and to be replaced by pressing the plug onto the neck after aseptic filling of the pouch with the flowable product, wherein the method further comprises:

arranging at least the end portion of the neck and the plug of the empty spouted pouch in an aseptic environment of the filling machine, wherein in said aseptic environment:

the plug is removed from the neck by the filling machine, the pouch is filled with a flowable product via the product passage in the spout body, the filled pouch is reclosed by replacing the plug by pressing the plug onto the top end of the neck and causing an interference fit with the neck, wherein the method further comprises:

providing a manually operable rotational cap that is adapted to be assembled on the spouted pouch after said aseptic filling of the pouch and said replacing of the plug onto the neck, wherein the cap has a cap body that is molded of thermoplastic material, which cap body includes an annular skirt having an interior surface, an exterior surface, and a lower end, wherein a section of the interior of the skirt is provided with an integrally molded second cap connector formation that is adapted to cooperate with the first cap connector formation on the neck of the spout body, and wherein the cap body and the plug body are provided with cooperating snap-fit formations, and wherein the cap, below the skirt, is provided with an integrally molded tamper-evident structure that allows to visually evidence the first time opening of the filled pouch, and wherein the spout body, below the first cap connector formation, is provided with one or more integrally molded tamper-evident formations that cooperate with said tamper-evident structure of the cap, such that upon first time opening of the filled pouch the tamper-evident structure evidences said first time opening, wherein the method further comprises, with the plug replaced over the top end of the neck, the step of:

lowering the cap body over the plug in an manner causing the first and second cap connector formations to cooperate and causing the snap-fit formations to engage and thereby couple the plug to the cap, e.g. said lowering comprising screwing or pressing, wherein the cooperating snap fit formations couple the plug to the cap such that upon manually opening of the cap the plug remains coupled to the cap and is entrained with the cap so as to open the product passage and allowing dispensing of the flowable product from the filled pouch.

As explained the method allows for the cap to be exempted from any sterilizing process. This is advantageous, e.g. in view of the fact that tamper-evident structures notoriously are difficult to sterilize due to the presence of small gaps and other intricate details. For example when a sterilizing liquid or vapour is used it is hard to ensure that no residue remains within corners, gaps, or other crevices, of the tamper-evident structure.

In an embodiment it is envisaged that prior to removal of the plug, only the plug and the neck of the spout are sterilized instead of the entire spouted pouch, with only said sterilized parts entering the aseptic environment of the filling machine for further removal of the plug, filling, and replacing of the plug.

It will be appreciated that, if no aseptic qualities are required, the steps of removal of the plug, filling, and replacing of the plug may also be conducted in a non-aseptic environment.

It will be appreciated that the spout, plug, and/or cap may be provided with one or more of the details referred to above.

In an embodiment the step of lowering the cap body over the plug is performed in a non-aseptic environment, e.g. outside of the filling machine.

In an embodiment the filling machine comprises a filling nozzle, wherein the filling nozzle comprises a front end portion that is adapted to the introduced into the neck of the spout, and wherein the filling nozzle is not in contact with the annular sealing surface of the neck of the spout onto which the sealing surface of the outer annular wall of the plug body engages.

In an embodiment the filling machine comprises in said aseptic environment a plug removal and/or replacement device that engages the plug, e.g. engages a peripheral groove in the exterior of the plug body, e.g. in the top portion thereof. It will be appreciated that one device may perform both tasks or that two distinct devices are provided for these tasks.

In an embodiment the filling machine comprises, in said aseptic environment, a plug retention member that is adapted to temporarily support the removed plug, prior to the plug being replaced onto the neck of the spout. For example the plug is replaced on the same spout from which the plug has been removed. In another approach the plug is replaced on the spout of another spouted pouch that is filled by the filling machine, e.g. onto the next spout. In an embodiment the method comprises retaining the removed plug by said plug retention member, e.g. wherein said plug removal and/or replacement device removes said plug and transfers the plug to said plug retention member and/or vice versa.

As discussed above it is preferred for the interference fit plug to be provided with an outer annular wall, of which the interior surface forms an annular sealing surface that hermetically seals onto a corresponding sealing surface on the exterior of the neck of the spout. The inventive method is however also advantageous in combination with an interference fit plastic plug that has an inner annular sealing wall that hermetically seals onto a corresponding sealing surface in the interior of the neck of the spout. In the latter embodiment the outer annular wall is preferably absent. In an embodiment of an internally sealing interference fit plug, the plug body preferably has a top portion with a peripheral shoulder that abuts against the top end of the neck of the spout when the spout is closed, with said top portion preferably having a diameter at most equal to the diameter of the top section of the neck or smaller.

In an embodiment wherein the plug has an inner annular wall to obtain a seal with the interior of the neck it can be envisaged that the plug body comprises a dome portion or the like adjoin the lower end of the inner annular wall. For example the dome portion is directed deeper into the neck of the spout when the plug is placed in the neck.

In an embodiment the plug body comprises one or more centering portions downwardly depending from the top portion of the plug body, e.g. posts or an inner annular wall as described above, and frictionally engages the interior surface of the neck when the plug is mounted over the top end of the neck. The plug retention member is adapted to engage on the one or more centering portions in an interference fit. Preferably the plug retention member is then spaced from the annular sealing surface of the outer annular wall of the retained plug so that any contact and resulting risk of scratching is avoided, notably in a high-speed filling machine.

In an embodiment the one or more centering portions of the plug body delimit an open bottom cavity for reception of a pin portion of the plug retention member therein, wherein the one or more centering portions engage on the pin in an interference fit. This, as explained above, allows for high speed operation whilst avoiding undue contact with the annular sealing surface of the plug body.

In an embodiment the centering portion of the plug body comprises an inner annular wall downwardly depending from the top portion of the plug body and coaxial with the outer annular wall, wherein the inner annular wall delimits the open bottom cavity for reception of a pin portion of the plug retention member therein, wherein the inner annular wall engages on the pin in an interference fit.

The present invention also relates to a method according to claim 21 for production of aseptically filled spouted pouches with a manually openable cap, which method comprises:

supplying an empty, preferably pre-sterilized, spouted pouch to an aseptic filling machine, which spouted pouch comprises:

a flexible material pouch body, a spout having a molded spout body of plastic material, said spout body having at a lower end thereof an attachment portion that is attached to the pouch body, wherein said spout body has at an upper end thereof a tubular neck, which neck has an interior surface delimiting at least a section of a product passage that extends from a lower product passage opening through the spout body to a mouth opening at a top end of the neck, said neck also having an exterior surface, arranging at least the end portion of the neck of the empty spouted pouch in an aseptic environment of the filling machine, filling, in said aseptic environment, the spouted pouch with a flowable product via the product passage in the spout body, placing, in said aseptic environment and by means of a device of the filling machine, a sterilized interference fit plastic plug onto the top end of the neck of the filled pouch, by pressing the plug onto the top end of the neck and causing an interference fit with the neck, such that the plug is releasably mounted onto, e.g. over, the top end of the neck of the spout body and hermetically seals the product passage of the spout body, which plug has a molded plug body of plastic material, wherein the plug body has a top portion and a downward depending annular wall, e.g. outer annular wall, adapted to be fitted onto a top section of the tubular neck of the spout, wherein said annular wall has a surface which embodies an annular sealing surface, e.g. an inwardly protruding seal bead, and wherein the exterior or interior surface of the top section of the neck embodies a cooperating annular sealing surface such that a hermetic seal is present between the annular wall of the plug and the neck of the spout body, wherein the exterior of the neck of the spout body, below the top section thereof, is provided with an integrally molded first cap connector formation, discharging the filled spouted pouch closed by said interference-fit plug from said aseptic environment, and entering a non-aseptic environment, wherein the method further comprises:

providing a manually operable rotational cap that is adapted to be assembled on the spouted pouch after said aseptic filling of the pouch and said placing of the plug onto the neck, wherein the cap has a cap body that is molded of thermoplastic material, which cap body includes an annular skirt having an interior surface, an exterior surface, and a lower end, wherein a section of the interior of the skirt is provided with an integrally molded second cap connector formation that is adapted to cooperate with the first cap connector formation on the neck of the spout body, and wherein the cap body and the plug body are provided with cooperating snap-fit formations, and wherein the cap, below the skirt, is provided with an integrally molded tamper-evident structure that allows to visually evidence the first time opening of the filled pouch, and wherein the spout body, below the first cap connector formation, is provided with one or more integrally molded tamper-evident formations that cooperate with said tamper-evident structure of the cap, such that upon first time opening of the filled pouch the tamper-evident structure evidences said first time opening, wherein the method further comprises, after said discharging of the filled spouted pouch closed by said interference-fit plug from said aseptic environment and in a non-aseptic environment, the step of:

lowering the cap body over the plug in an manner causing the first and second cap connector formations to cooperate and causing the snap-fit formations to engage and thereby couple the plug to the cap, e.g. said lowering comprising screwing and/or pressing, wherein the cooperating snap fit formations couple the plug to the cap such that upon manually opening of the cap the plug remains coupled to the cap and is entrained with the cap so as to open the product passage and allowing dispensing of the flowable product from the filled pouch.

This method e.g. covers an embodiment wherein the spouted pouch is first closed by another closure member than the plug over which the cap is later placed, e.g. a removable and disposable foil closure over the top end of the neck of the spout. For example such a foil is present when the pre-made empty spouted pouches are irradiated and the removed and discarded in the aseptic environment of the filling machine. After filling the plug is placed onto the neck, preferably said plug having the discussed outer annular wall, and then the filled and closed pouch is conveyed out of the aseptic environment. Then the capping machine places the cap, with the plug and cap mating via a snap fit and the cap mating with the neck of spout via a thread, bayonet, or direct snap fit.

This method also covers an embodiment wherein open and empty spouted pouches are conveyed to a filling machine and then first at least internally subjected to a sterilizing treatment, e.g. the flushing the interior of the pouch with a gaseous sterilant, or steam, etc.

Then the sterilized pouch or the neck portion thereof is introduced into an aseptic environment and the pouch is then filled. Once filled the plug and cap can be provided as in the previous paragraph.

It will be appreciated that the spout, plug, and cap may have one or more of the further features as discussed herein.

The present invention also relates to a method for production of filled spouted pouches with a manually openable cap, preferably aseptically filled, which method comprises:

supplying an empty, preferably pre-sterilized, spouted pouch to an aseptic filling machine, which spouted pouch comprises:

a flexible material pouch body, a spout having a molded spout body of plastic material, said spout body having at a lower end thereof an attachment portion that is attached to the pouch body, wherein said spout body has at an upper end thereof a tubular neck, which neck has an interior surface delimiting at least a section of a product passage that extends from a lower product passage opening through the spout body to a mouth opening at a top end of the neck, said neck also having an exterior surface, and wherein the exterior surface of the top section of the neck embodies an annular sealing surface such that a hermetic seal can be created with an outer annular wall of a plug, wherein the exterior of the neck of the spout body, below the top section thereof, is provided with an integrally molded first cap connector formation, arranging at least the top section of the neck of the empty spouted pouch in an aseptic environment of the filling machine, filling by means of a filling nozzle of said filling machine, in said aseptic environment, the spouted pouch with a flowable product via the product passage in the spout body, wherein the filling nozzle in said filling step does not contact the exterior of the neck of the spout, at least does not contact the an annular sealing surface thereof, placing, in said aseptic environment and by means of a device of the filling machine, an interference fit plastic plug over the top end of the neck of the filled pouch, by pressing the plug over the top end of the neck and causing an interference fit with the neck, such that the plug is releasably mounted over the top end of the neck of the spout body and hermetically seals the product passage of the spout body, which plug has a molded plug body of plastic material, wherein the plug body has a top portion and a downward depending outer annular wall adapted to be fitted over the top section of the tubular neck of the spout, wherein an interior surface of said annular wall embodies an annular sealing surface, e.g. an inwardly protruding seal bead, that cooperates with the sealing surface on the neck of the spout, discharging the filled spouted pouch closed by said interference-fit plug from said aseptic environment, and entering a non-aseptic environment, wherein the method further comprises:

in said non-aseptic environment, lowering a manually operable rotational cap over the plug in an manner causing cap connector formations of the cap and the neck of the spout respectively to cooperate and causing the snap-fit formations of the plug and the cap respectively to engage and thereby couple the plug to the cap, e.g. said lowering comprising screwing and/or pressing, wherein the cap has a cap body that is molded of thermoplastic material, which cap body includes an annular skirt having an interior surface, an exterior surface, and a lower end, wherein a section of the interior of the skirt is provided with an integrally molded second cap connector formation that is adapted to cooperate with the first cap connector formation on the neck of the spout body, and wherein the cap body and the plug body are provided with cooperating snap-fit formations, wherein the cooperating snap fit formations couple the plug to the cap such that upon manually opening of the cap the plug remains coupled to the cap and is entrained with the cap so as to open the product passage and allowing dispensing of the flowable product from the filled pouch.

It will be appreciated that the spout, plug, and cap may have one or more of the further features as discussed herein.

The present invention also relates to a combination of a plug and of a cap that are embodied to be assembled on the neck of a flowable product container, e.g. on a spouted pouch. The combination may comprise the plug and cap as described herein for use with a spouted pouch. It is envisaged that the same combination of plug and cap may also be of use for other containers having a neck, e.g. a molded plastic container with a neck, e.g. a plastic bottle, or a carton with a plastic spout attached thereon, and then offer the same advantages as described above.

A combination of the cap and plug according to the invention comprises:

an interference-fit plug, wherein the plug is adapted to be releasably mounted over a top end of a tubular neck of a flowable product container in an interference fit and to hermetical seal a product passage through said neck, which plug has a molded plug body of plastic material, wherein the plug body has a top portion and a downward depending outer annular wall adapted to be fitted over a top section of the tubular neck, wherein the outer annular wall has an interior surface which embodies an annular sealing surface, e.g. in inward protruding seal bead, that is adapted to cooperate with an annular sealing surface on an exterior surface of a top section of the neck such that a hermetic seal is present between the outer annular wall of the plug and the neck, wherein the plug is adapted to be removed by a filling machine and to be replaced by pressing the plug onto the neck after filling of the container with a flowable product, wherein said plug removal, filling, and replacing of the plug may be performed in an aseptic environment, wherein said combination further comprises:

a manually openable cap that is adapted to be assembled on the container after the filling of the container and the replacing of the plug onto the neck, wherein the cap has a cap body that is injection molded of thermoplastic material, which cap body includes an annular skirt having an interior surface, an exterior surface, and a lower end, wherein a section of the interior of the skirt is provided with an integrally molded second cap connector formation that is adapted to cooperate with a first cap connector formation on the exterior of the neck below the top section thereof, and wherein the cap body and the plug body are provided with cooperating snap-fit formations, wherein the cap body and the plug body are embodied such that, with the plug replaced over the top end of the neck, the cap body can be lowered over the plug in an manner causing the first and second cap connector formations to cooperate and causing the snap-fit formations to engage and thereby couple the plug to the cap, wherein the cooperating snap fit formations coupling the plug to the cap are such that upon manually opening of the cap the plug remains coupled to the cap and is entrained with the cap so as to open the product passage and allowing dispensing of the flowable product from the filled container, and wherein, preferably, the cap, below the skirt, is provided with an integrally molded tamper-evident structure that allows to visually evidence the first time opening of the filled container.

In an embodiment of said combination of cap and plug the skirt of the cap is provided with at least one pair of diametrically opposed windows, e.g. directly beneath the top wall of the cap, wherein the plug is provided with one or more snap-fit formations that extend into said one or more windows and/or are supported on an eventual inward ledge, e.g. peripheral, at the interior side of the cap and aligned with the lower edge of said one or more windows.

The present invention also relates to a method for production of aseptically filled spouted pouches with a manually openable cap, which method comprises:

manufacturing empty spouted pouches, wherein each spouted pouch comprises:

a flexible material pouch body, a spout having a molded spout body of plastic material, said spout body having at a lower end thereof an attachment portion that is attached to the pouch body, wherein said spout body has at an upper end thereof a tubular neck, which neck has an interior surface delimiting at least a section of a product passage that extends from a lower product passage opening through the spout body to a mouth opening at a top end of the neck, said neck also having an exterior surface, and wherein a surface of the top section of the neck embodies an annular sealing surface, wherein the spout body, below the top section thereof, is provided with an integrally molded cap connector formation, an interference fit plastic plug that is fitted onto, e.g. over, the top end of the neck in an interference fit, which plug has an annular sealing surface such that the plug hermetically seals onto the neck in cooperation with the annular sealing surface of the neck, collecting the empty spouted pouches in groups on multiple transport rails, irradiating said transport rails with said spouted pouches, e.g. said transport rails with said spouted pouches being packaged in an envelope which is placed in an irradiation machine, supplying said irradiated transport rails with empty, irradiated spouted pouch to an aseptic filling machine, discharging said spouted pouches from said transport rails into said filling machine, entering said spouted pouches in a sterilant vapour chamber, e.g. filled or circulated with hydrogen peroxide vapour, such that exterior surfaces of the empty spouted pouches are sterilized, entering said externally sterilized spouted pouches into an aseptic filling chamber of the filling machine, e.g. at least the top section of the neck of the empty spouted pouch entering in said aseptic chamber of the filling machine, removing the plug from the neck of a spouted pouch in said aseptic chamber, filling by means of a filling nozzle of said filling machine, in said aseptic chamber, the spouted pouch with a flowable product via the product passage in the spout body, replacing, in said aseptic environment and by means of a device of the filling machine, said interference fit plastic plug onto, e.g. over, the top end of the neck of the filled pouch, causing an interference fit with the neck, such that the plug is releasably mounted over the top end of the neck of the spout body and hermetically seals the product passage of the spout body, discharging the filled spouted pouch closed by said interference-fit plug from said aseptic chamber, and entering a non-aseptic environment, wherein the method further comprises:

in said non-aseptic environment, lowering a manually operable rotational cap, e.g. a screw cap, over the plug in an manner causing cap connector formations of the cap and the neck of the spout respectively to cooperate and causing the snap-fit formations of the plug and the cap respectively to engage and thereby couple the plug to the cap, e.g. said lowering comprising screwing and/or pressing, wherein the cooperating snap fit formations couple the plug to the cap such that upon manually opening of the cap the plug remains coupled to the cap and is entrained with the cap so as to open the product passage and allowing dispensing of the flowable product from the filled pouch.

It will be appreciated that optional and/or preferred details discussed with reference to one aspect of the invention are equally applicable to another aspect of the invention.

The invention also relates to a container filled with a flowable product, e.g. a spouted pouch, e.g. a foodstuff or beverage, and provided with the plug and cap as discussed herein.

Figure 2:
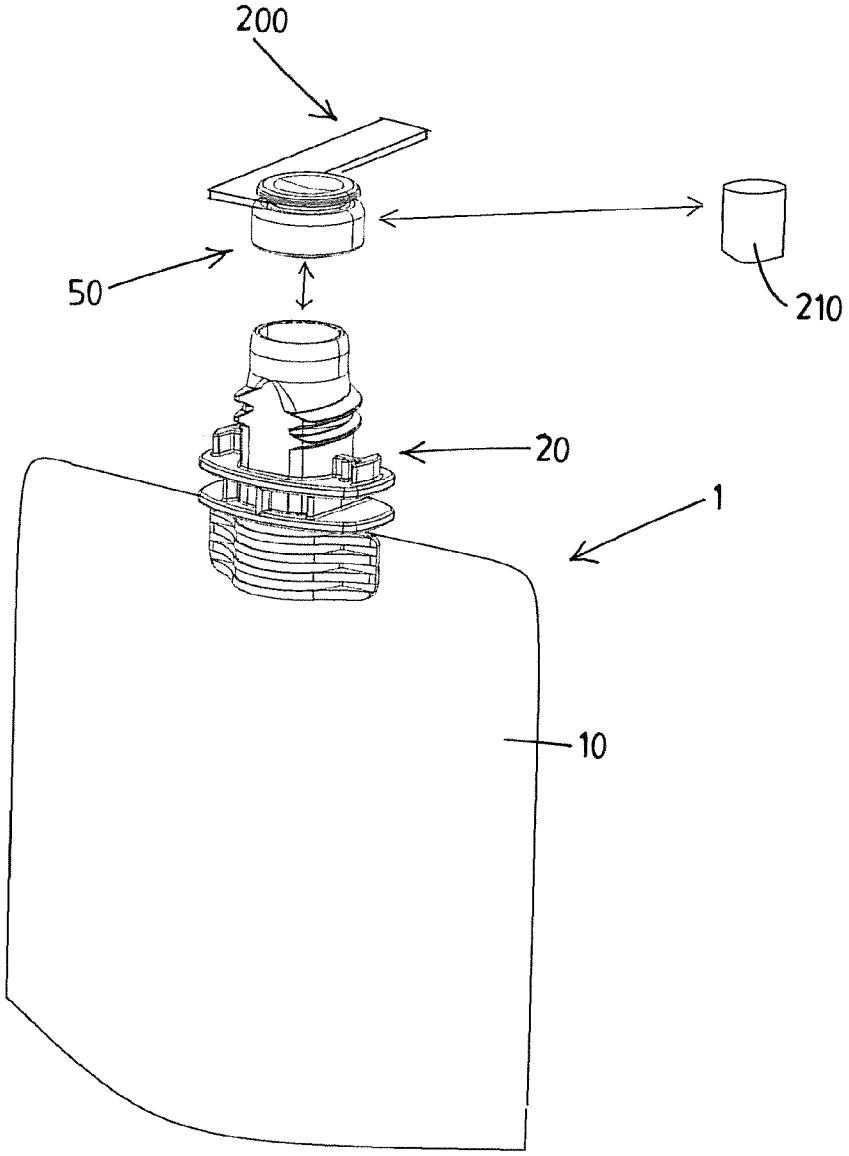
Figure 3:
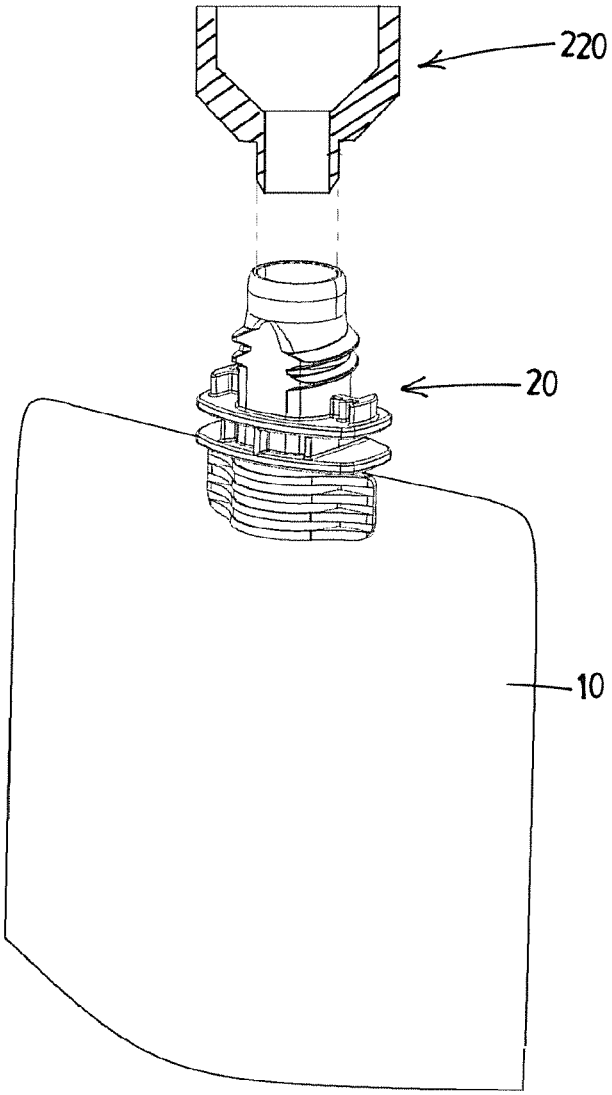
Figure 4:
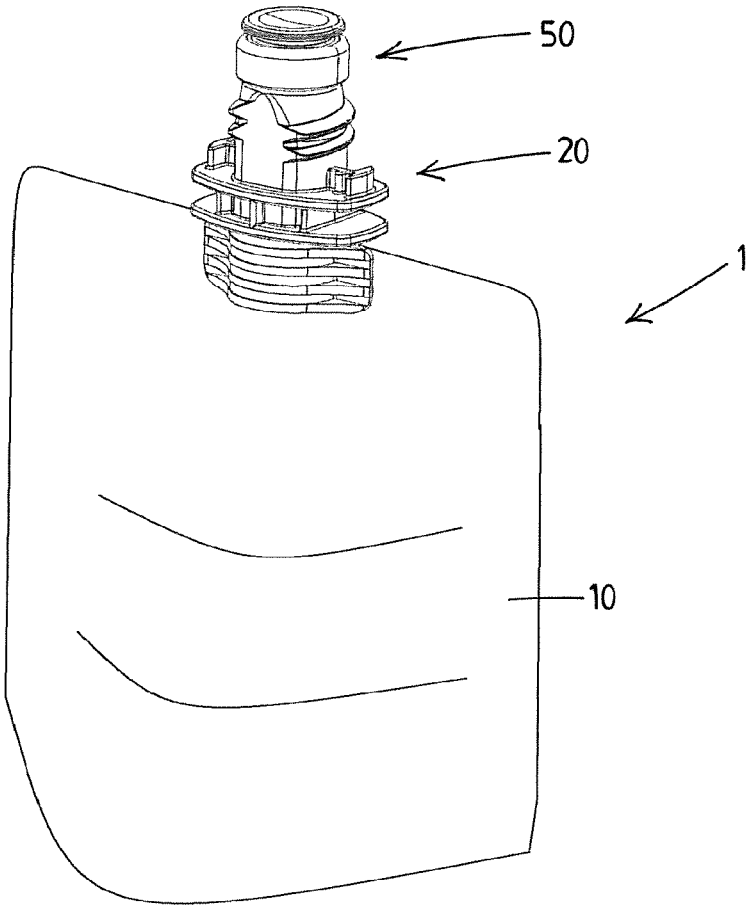
Figure 5:
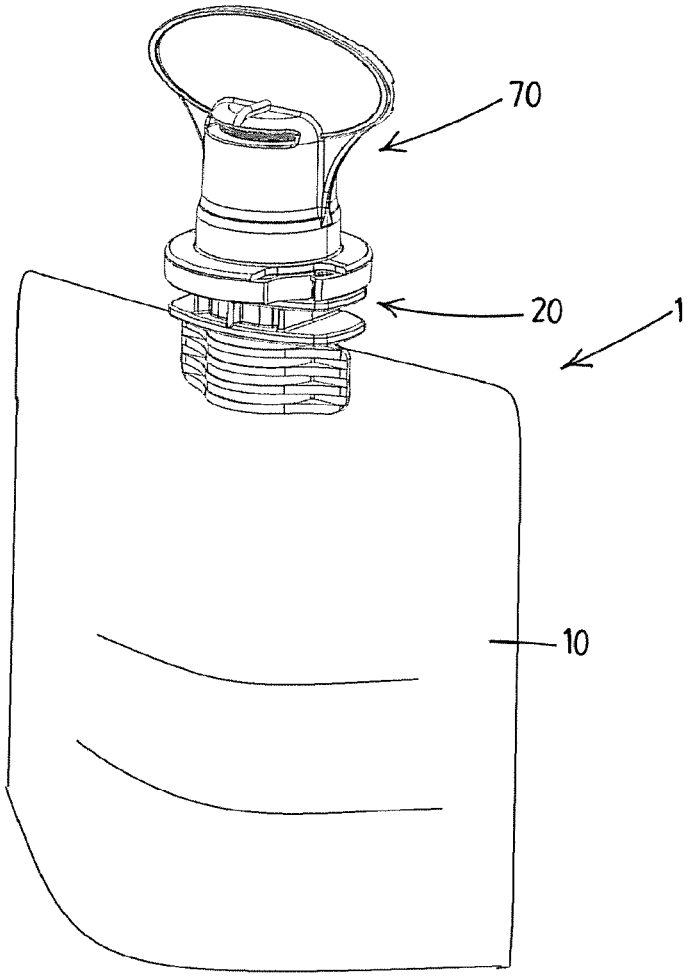
Figure 6:
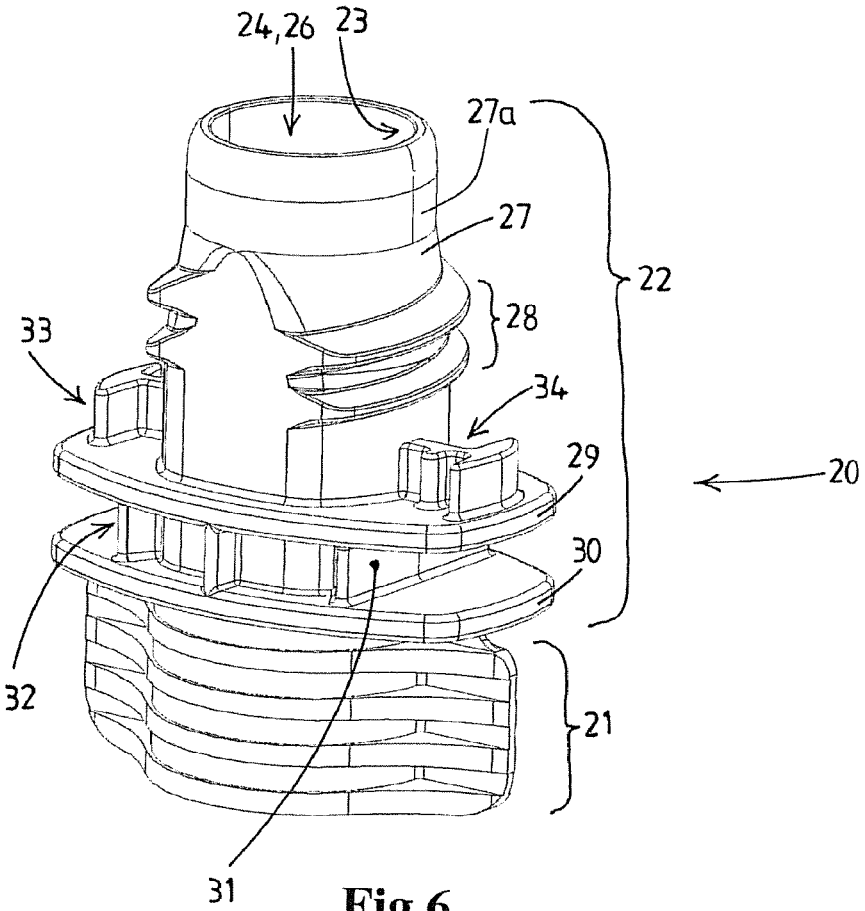
Figure 7:
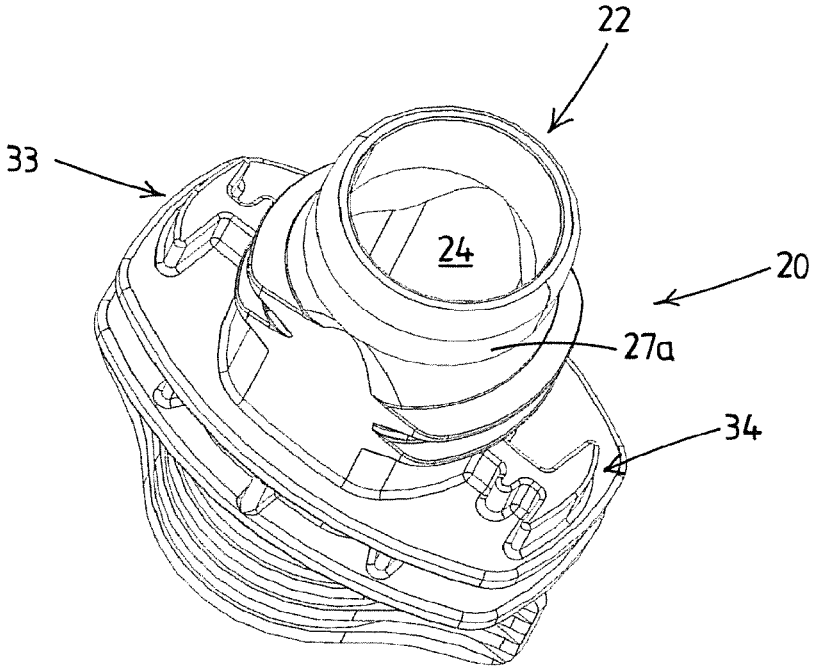
Figure 8:
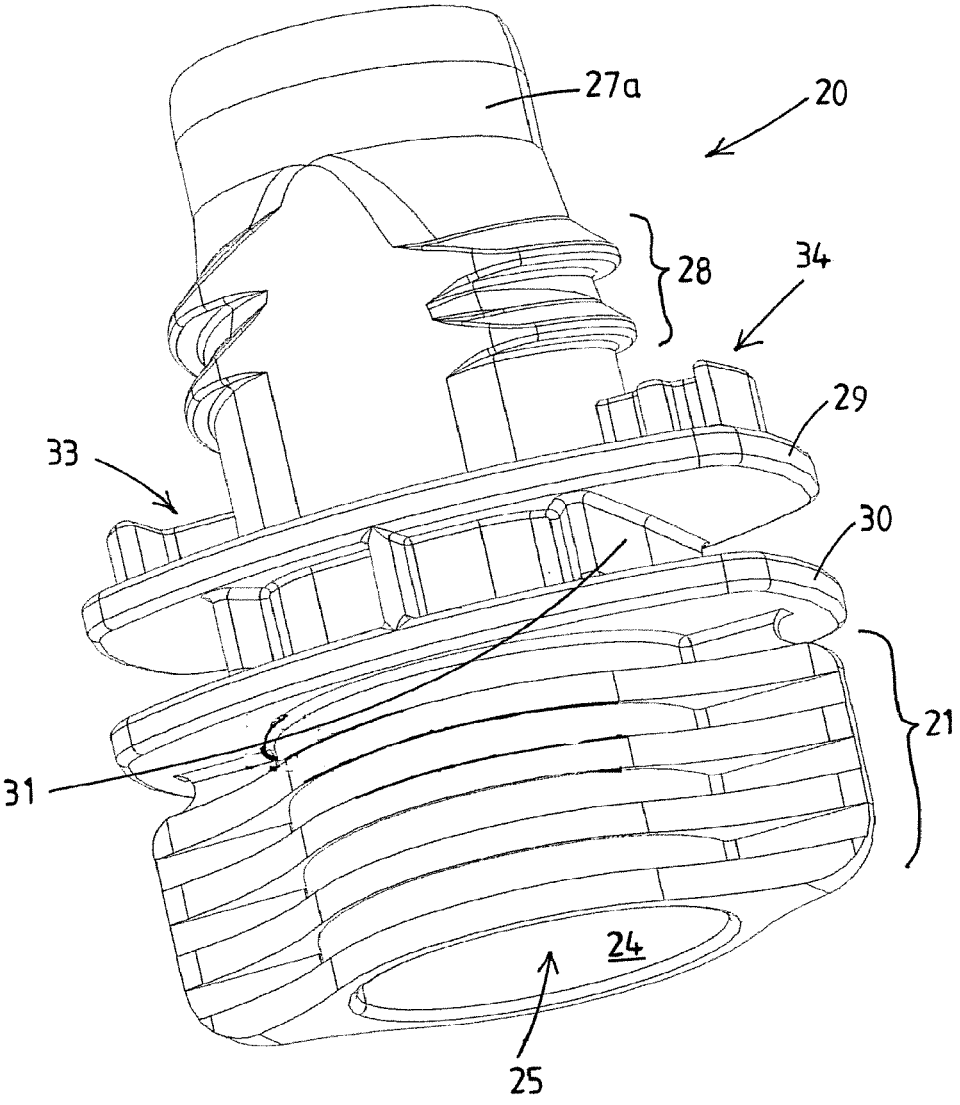
Figure 9:
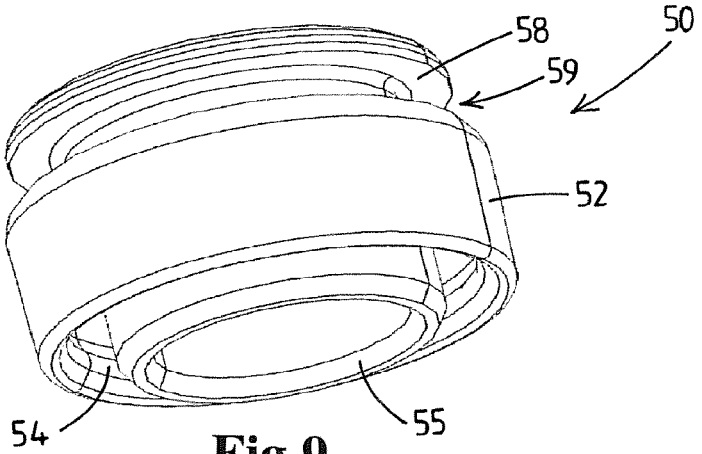
Figure 10:
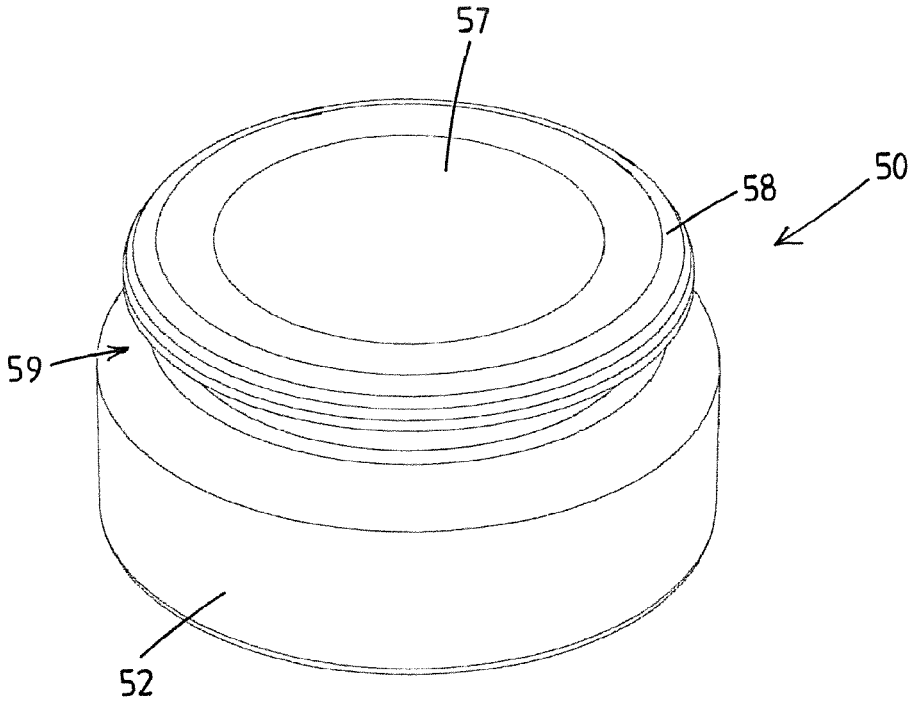
Figure 11:
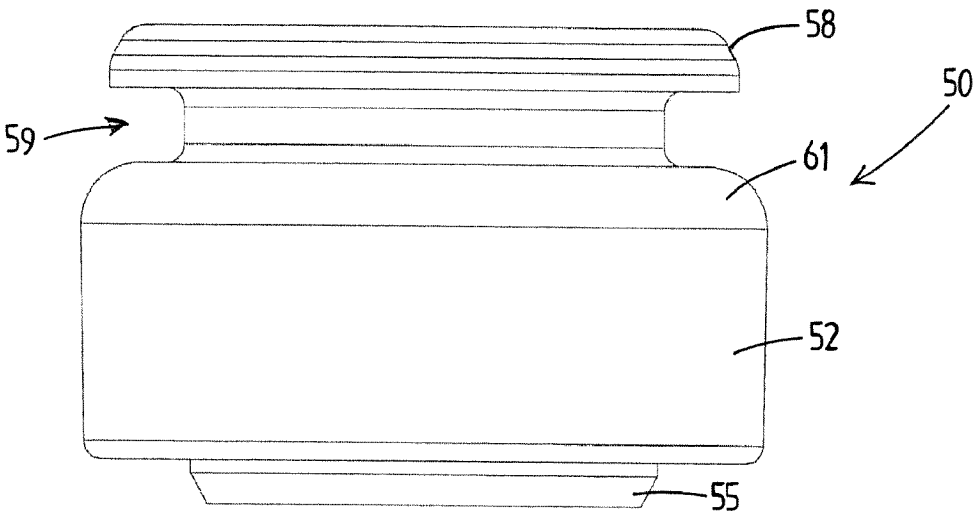
Figure 12:
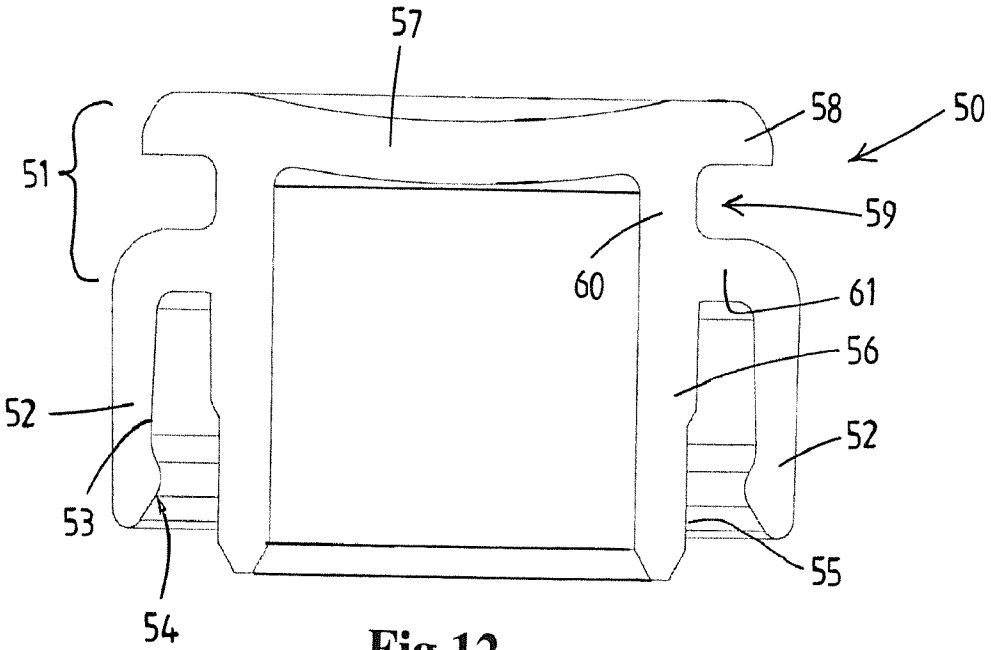
Figure 13:
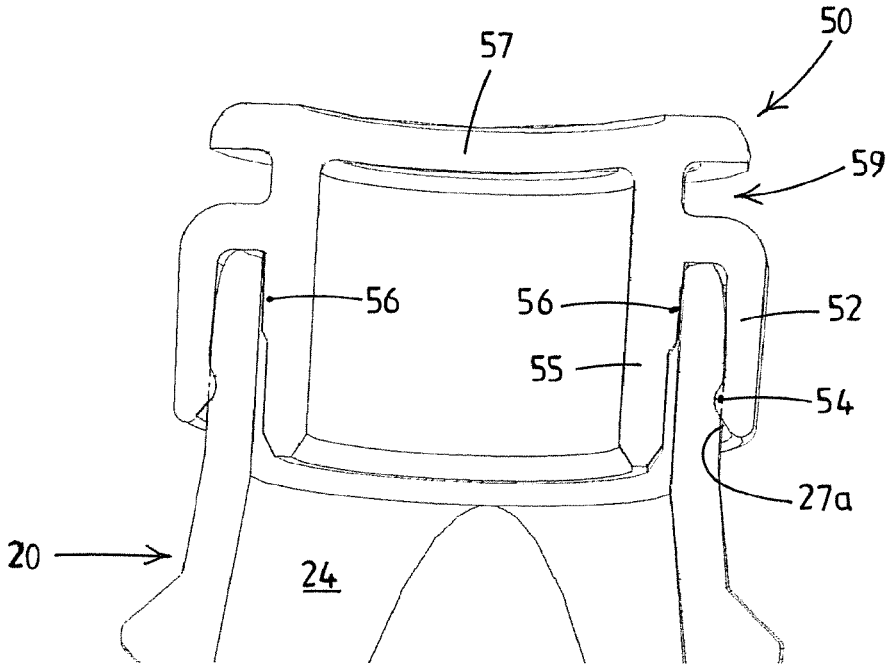
Figure 14:
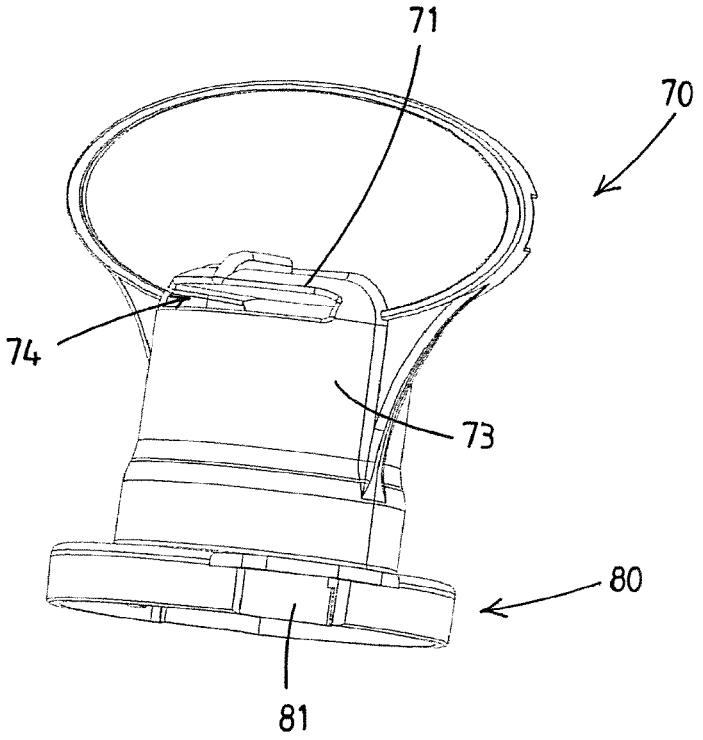
Figure 15:
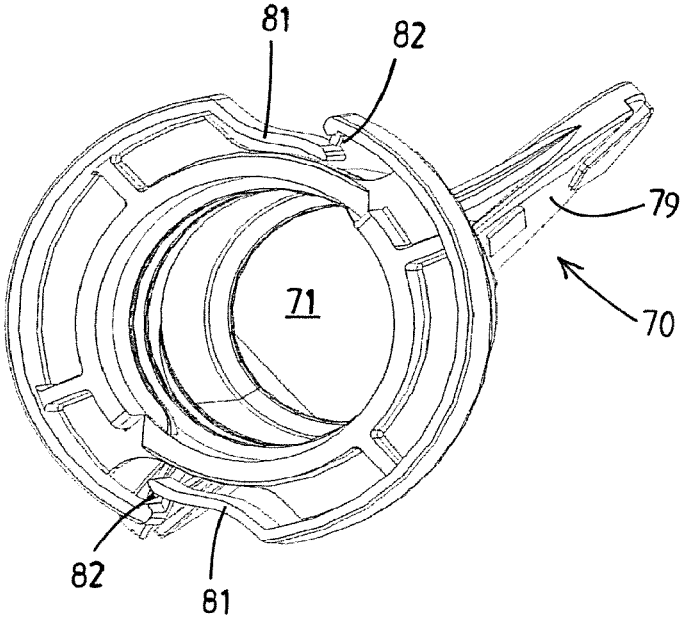
Figure 16:
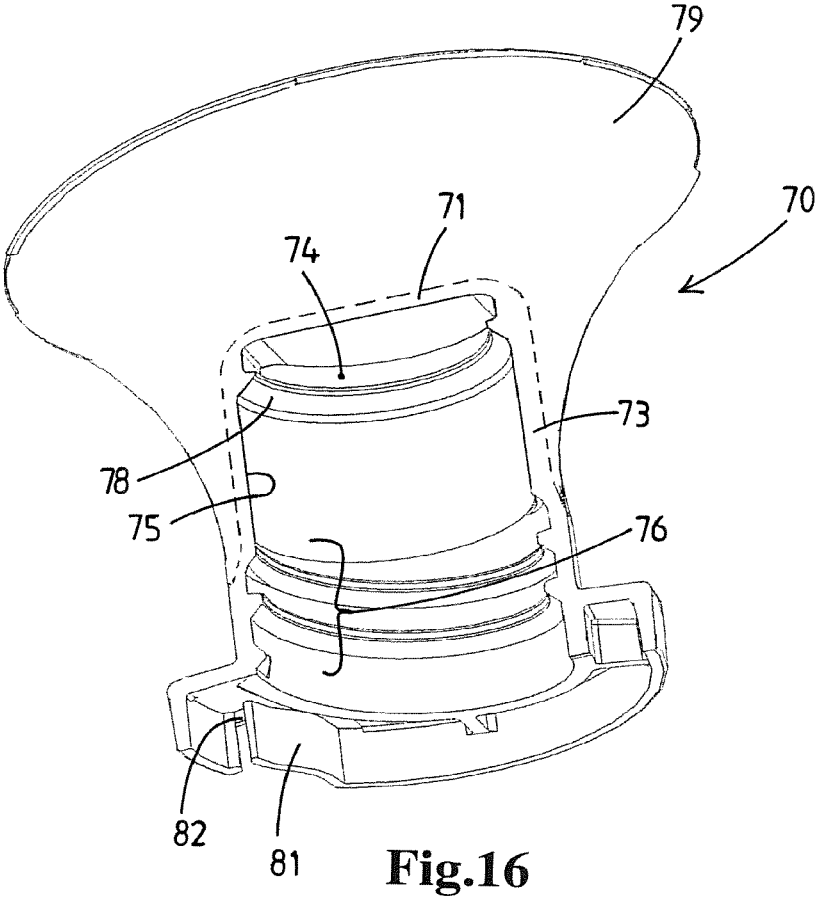
Figure 17:
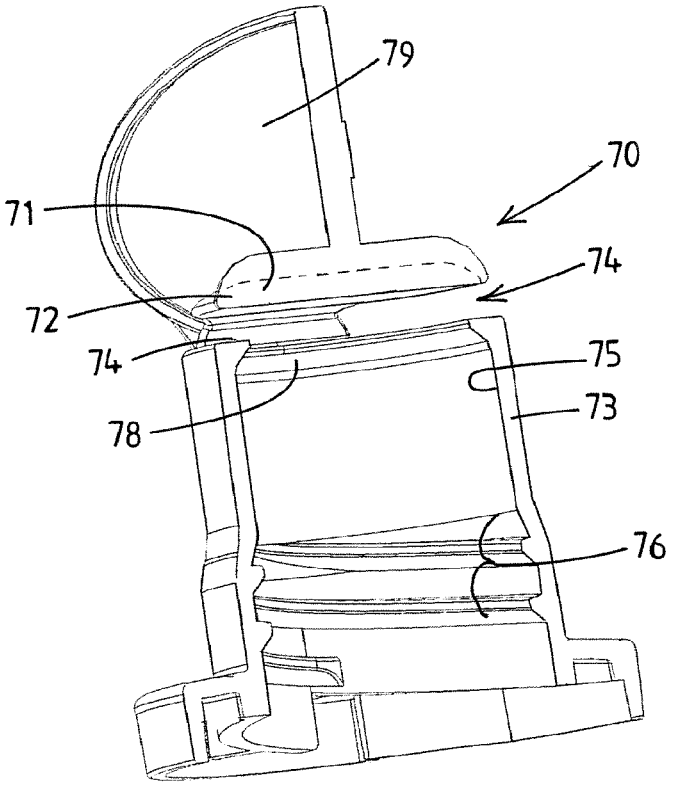
Figure 18:
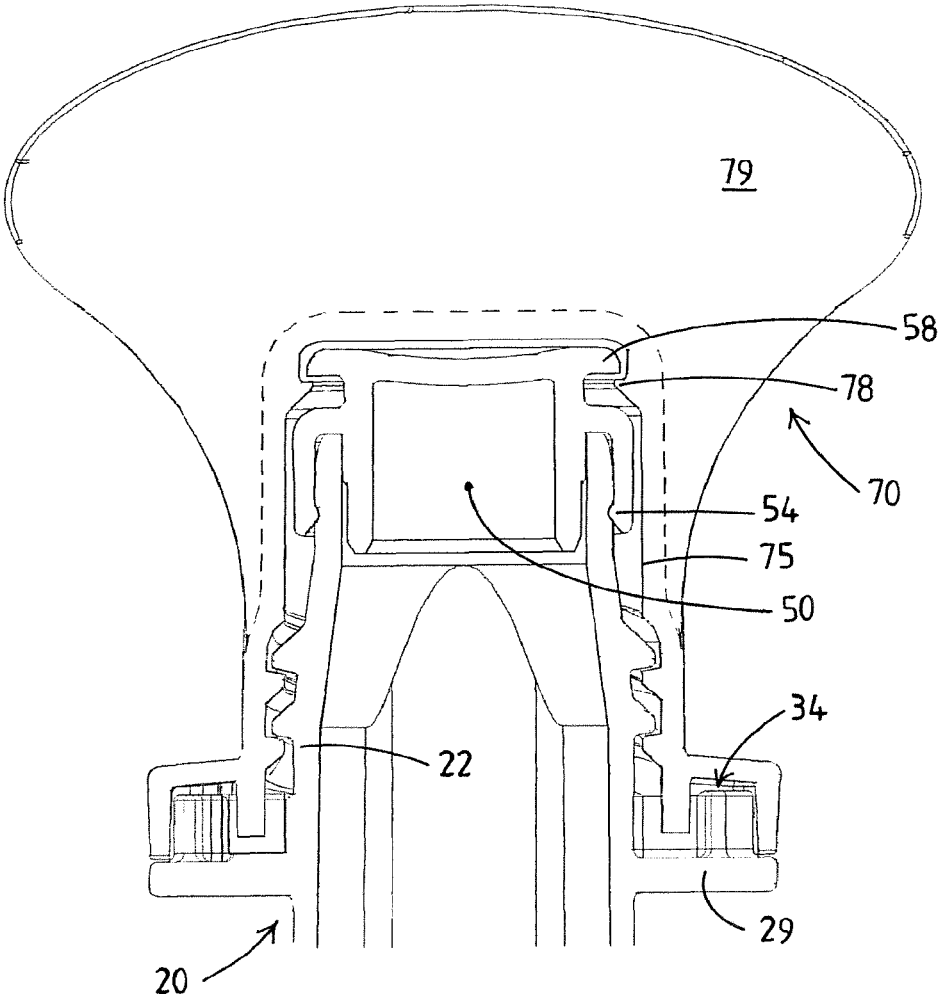
Figure 19:
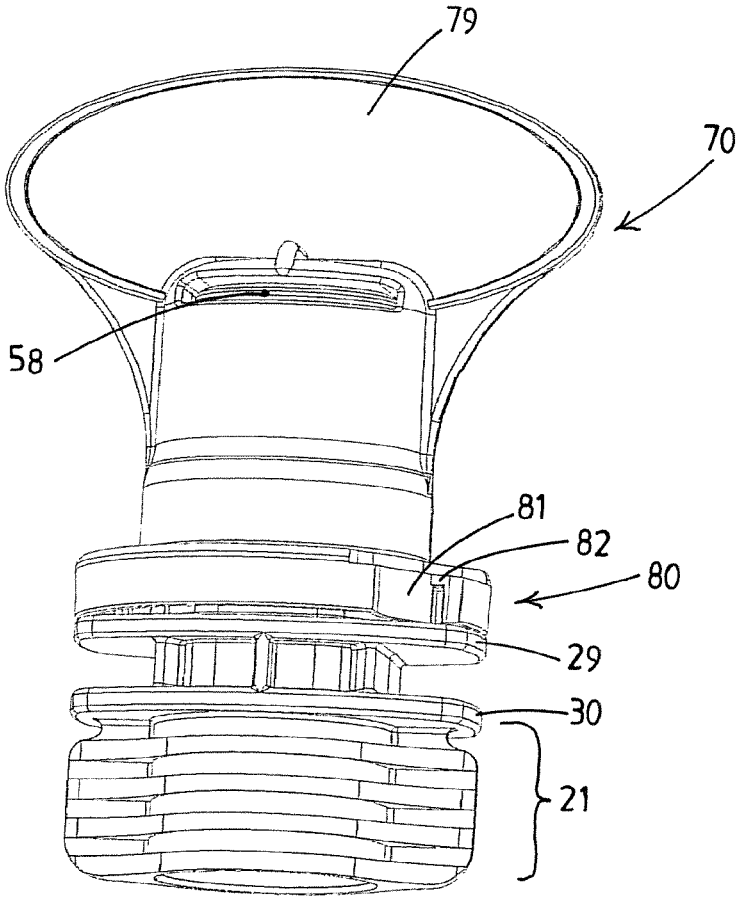
Figure 20:
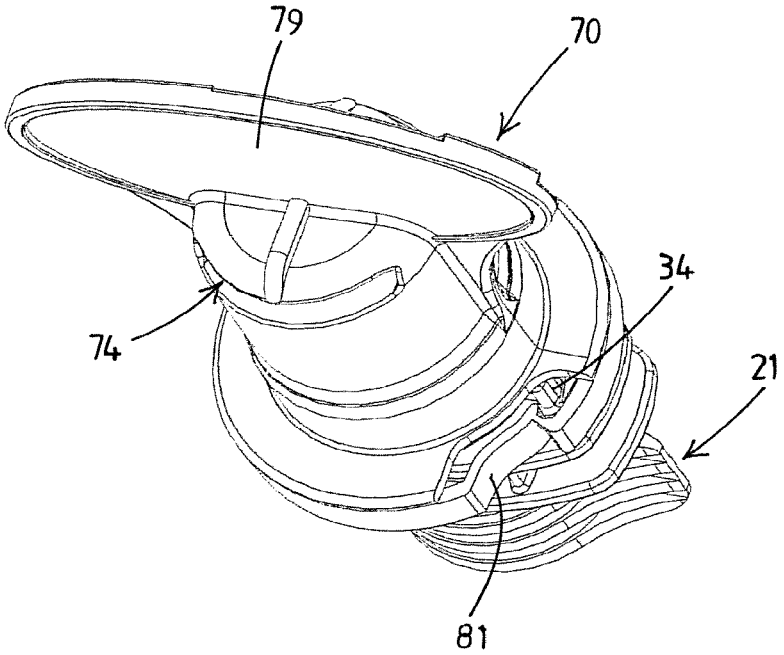
Figure 21:
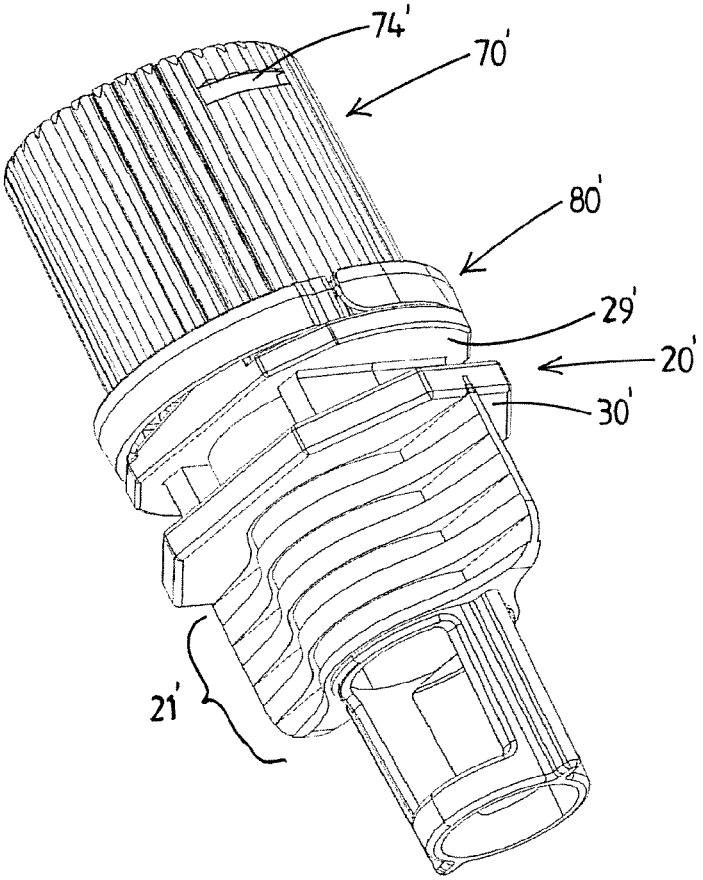
Figure 22:
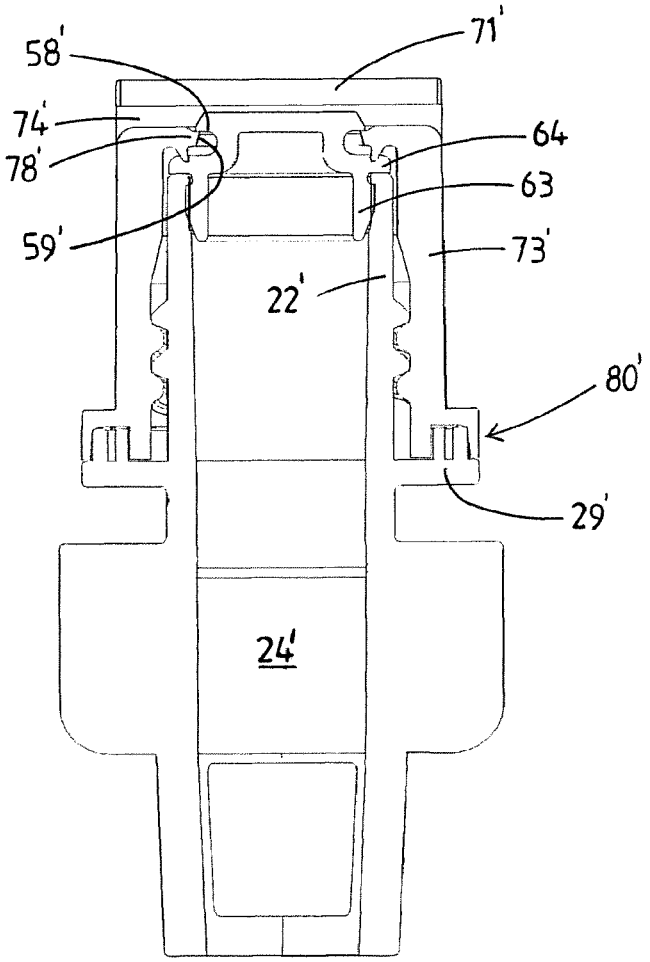
Figure 23:
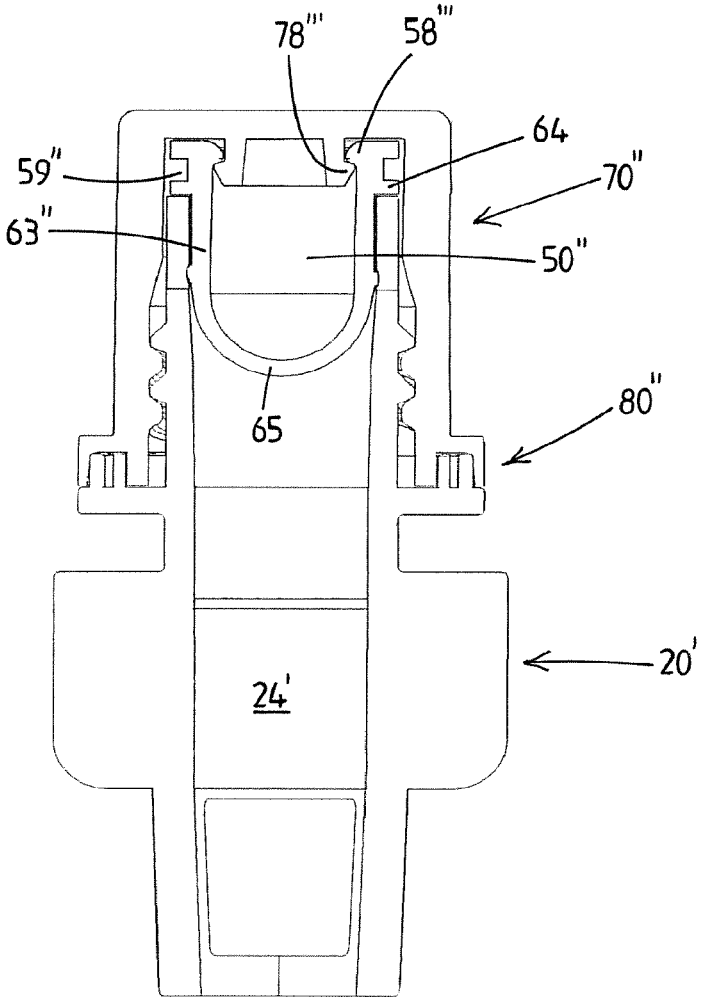
Figure 24:
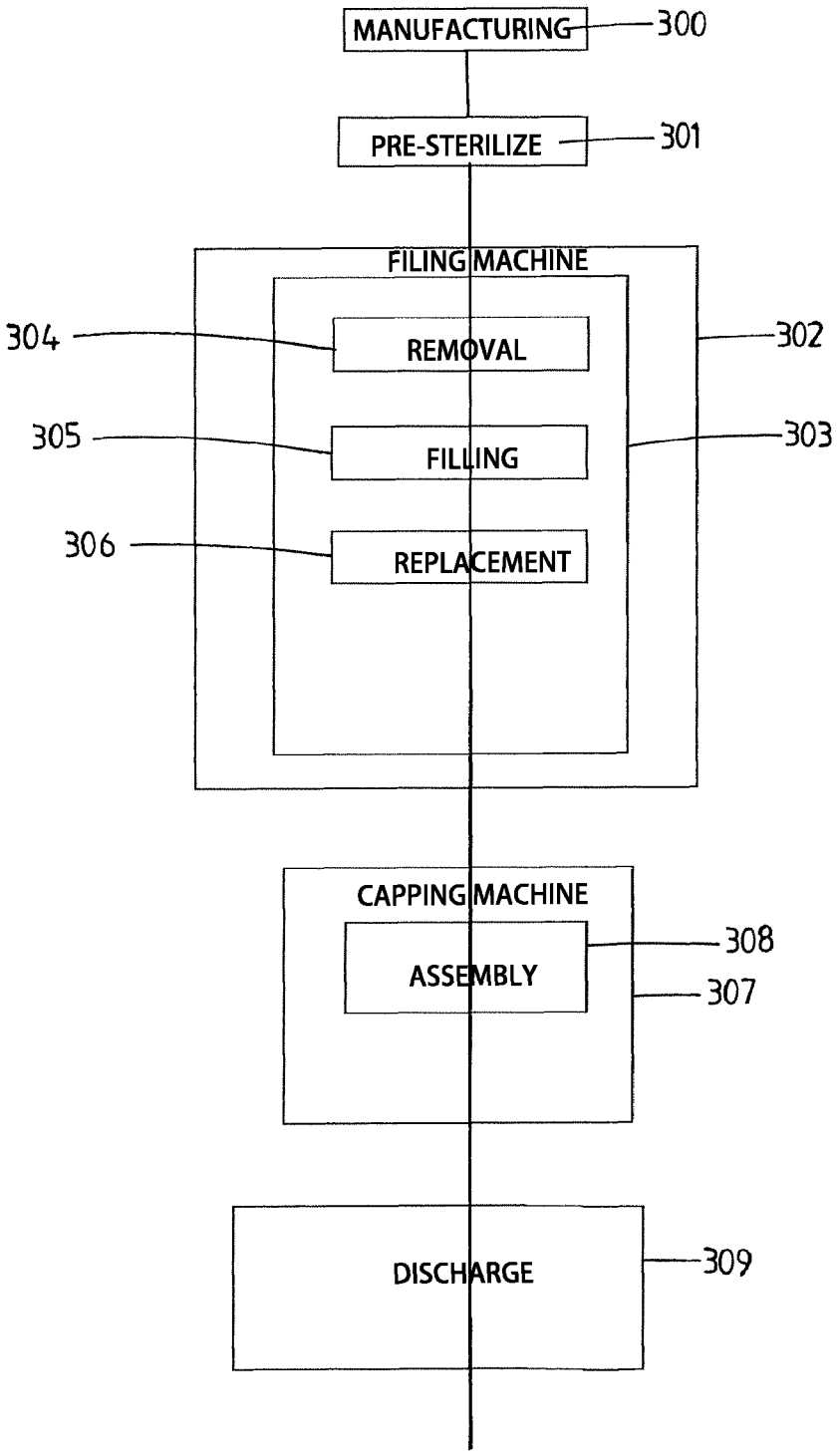

The invention will now be described with reference to the appended drawings. In the drawings:

FIG. 1 shows an example of a combination according to the invention, wherein the still empty spouted pouch is hermetically sealed by the plug, FIG. 2 illustrates the removal of the plug from the neck of the spout and the temporary plug retention member, FIG. 3 illustrates the filling of the opened spouted pouch by means of a filling nozzle of a filling machine, FIG. 4 illustrates the plug being replaced on the filled spouted pouch, FIG. 5 illustrates the cap being assembled onto the filled spouted pouch, FIGS. 6-8 illustrate the spout of the combination of FIG. 1, FIGS. 9-12 illustrate the plug of the combination of FIG. 1, FIG. 13 illustrates in a cross-sectional view the interference fit of the plug on the neck of the spout, FIGS. 14, 15 illustrate the cap of the combination of FIG. 1, FIG. 16 shows the cap in a first cross-section, FIG. 17 shows the cap in a second cross-section perpendicular to the first cross-section, FIG. 18 illustrates in cross-sectional view the assembly of the cap over the plug and the neck of the spout, FIGS. 19, 20 illustrate the assembled combination with the spout, plug, and cap, FIGS. 21, 22 illustrate an alternative embodiment of spout, plug, and cap for use with the inventive method, FIG. 23 illustrates yet another alternative embodiment of spout, plug, and cap for use with the inventive method, FIG. 24 is a flow diagram illustrating an embodiment of the inventive method for aseptically packaging a flowable product in spouted pouches.

With reference to FIGS. 1-5 first the method for production of aseptically filled spouted pouches with a manually openable cap will be elucidated.

FIG. 1 represents the step of supplying an empty spouted pouch 1 to an aseptic filling machine (not shown). The empty spouted pouch 1 has been pre-sterilized, e.g. by irradiation.

Generally the empty spouted pouch to be supplied to the filling machine comprises a flexible material pouch body 10, a plastic spout 20, and an interference-fit plug 50.

The plastic plug 50 is releasably mounted over the top end of the neck of the spout body and hermetically seals the product passage of the spout body.

In this condition the pouch 1 is introduced into a filling machine, wherein at least the region of the spout 20 and the plug 50 enter into an aseptic environment, e.g. enter into an aseptic chamber, e.g. a tunnel, of the filling machine (or the entire filling machine being placed in an aseptic environment).

FIG. 2 illustrates the step of removal of the plug 50 from the neck by the filling machine, here by a schematically illustrated plug removal and replacement device 200.

FIG. 2 also illustrates schematically the provision in the filling machine of a plug retention member 210 that is adapted to temporarily support the removed plug 50. This retention member 210 is arranged in the mentioned aseptic environment. It is illustrated that the plug removal and replacement device 200 removes the plug 50 from the neck, e.g. by simply lifting the plug, and then transfers the plug to the plug retention member. Subsequently the pouch can be filled and the plug 50 replaced on the same spout.

For example the filling machine is a carousel machine wherein the spouted pouch passes through an arctuate path with the filling nozzle and the plug retention member moving in sync with the moving spouted pouch. In another embodiment the plug may be replaced on the spout of another spouted pouch filled by the filling machine.

FIG. 3 illustrates the step of filling the pouch 1 by means of a filling nozzle 220 of the filling machine. The nozzle 220 is brought into sealing engagement with the spout 20 in order to avoid spillage. As the pouch was empty prior to filling no removal of air is required prior to the filling. This step of filling is done in the aseptic environment.

Once the pouch 1 is sufficiently filled, the nozzle 220 is disengaged from the spout 20. Then, as illustrate in FIG. 2 the plug 50 is taken from the retention member 210 and replaced onto the spout 20. The plug 50 is pressed over the top end of the neck and thereby an interference fit with the neck is established. The filled pouch 1 is thus closed hermetically by the plug 50, as is illustrated in FIG. 4.

FIG. 5 illustrates that a manually operable rotational plastic cap 70 has been assembled on the spouted pouch 1 after the aseptic filling of the pouch and the replacing of the plug onto the neck. As preferred, this step is done by a capping machine that is arranged in a non-aseptic environment, with the caps 70 not being subjected to a sterilizing treatment.

The cap 70 is provided with an integrally molded tamper-evident structure 80 that allows to visually evidence the first time opening of the filled pouch. The spout body is provided with one or more tamper-evident formations that cooperate with the tamper-evident structure of the cap, such that upon first time opening of the filled pouch the tamper-evident structure evidences said first time opening.

As will be discussed in more detail below the assembly of the cap 70 comprises the lowering of the cap body over the plug 50 in a manner causing cap connector formations on the neck and the skirt of the cap to cooperate and also causing snap-fit formations on the plug and on the cap to engage. The latter couple the plug to the cap, whereas the cooperating cap connector formations couple the cap to the neck.

The snap-fit coupling between the plug 50 and the cap 70 is such that upon manually opening of the pouch the plug remains coupled to the cap and is entrained with the cap so as to open the product passage and allowing dispensing of the flowable product from the filled pouch.

With reference to FIGS. 6-13 details of the spout 20 and the plug 50 will be discussed as well as the sealing cooperation between the spout 20 and the plug 50.

The spout 20 has a spout body that has been injection molded as a monolithic piece of suitable plastic material as is preferred.

The spout body has at a lower end thereof an attachment portion 21, that is adapted to be attached to the pouch body, e.g. by heat sealing techniques. At the upper end thereof the spout body has a tubular neck 22.

The depicted attachment portion 21 is adapted to secure the portion 21 between opposed panels or wall of the pouch 10 at an edge thereof. In another embodiment the attachment portion 21 may e.g. be embodied as annular planar flange in a plane normal to a vertical axis of the spout, wherein this flange is adapted to secure the spout to a panel of the pouch over an opening in said panel.

The depicted attachment portion 21 has a series of vertically spaced horizontal ribs, here four ribs. In an alternative example the portion may have three such ribs, e.g. to allow for a downward protruding boss on the underside of lower flange 30, e.g. centrally along each long side of said flange 30. Such a boss can prevent shiggling when the spout is conveyed over rails of handling equipment, e.g. filler.

The neck 22 has an interior surface 23 which delimits a section of a product passage 24 that extends from a lower product passage opening 25 through the spout body to a mouth opening 26 at a top end of the neck. The neck also has an exterior surface 27.

The exterior surface of the top section of the neck embodies an annular sealing surface 27*a* that is adapted to establish a hermetic seal with a corresponding sealing surface on the interior side of an outer annular wall of the plug 50.

Below the sealing surface 27*a*, the exterior of the neck of the spout body is provided with an integrally molded first cap connector formation, here embodied as a thread 28. The thread 28 e.g. is a single continuous thread, a double start thread, an interrupted thread as shown here, or otherwise.

Below the integrally molded first cap connector formation 28 and above the attachment portion 21, the spout body has a pair of upper and lower flanges 29, 30 extending around the neck. As is known in the field these flanges may be used in the course of conveyance of the spouted pouches 1, e.g. through the filling machine, e.g. with a support of guide member of the filling machine between the flanges 29, 30 at opposite sides of the neck.

A portion of the neck intermediate these flanges 29, 30 is provided with a pair of parallel vertical guide faces 31, 32 at diametrically opposed locations, e.g. allowing for guiding of the neck in a guide slot of the filling machine.

On top of the upper flange 29, here at diametrically opposed locations relative to the neck, the spout body is provided with integrally molded tamper-evident formations 33, 34 that are raised from the upper flange and adjoin the neck of the spout body.

The plug 50 has a monolithic molded plug body of plastic material as is preferred.

In the depicted example the plug body has a top portion 51 and a downward depending outer annular wall 52 that is adapted to be fitted over the top section of the tubular neck of the spout, 20.

The outer annular wall 52 has an interior surface 53 which embodies an annular sealing surface 54, here embodied by an inwardly protruding seal bead near the lower end of the wall 52. When the plug 50 is placed on the neck, the seal bead 54 forms a hermetic seal with the sealing surface 27*a* on the top section of the neck. As shown it is envisaged that the seal bead is slightly expanded when the plug 50 is pressed onto the neck. It is envisaged that this single seal between the plug and the neck is sufficient to create a closure of the pouch that guarantees the quality and shelf-life of the packaged flowable product. Therefore it is preferred that no additional seal is present between the plug and the neck and further no additional seal at other locations, e.g. between the cap and the neck.

The plug body further comprises an integrally molded inner annular wall 55 which is coaxial or concentric with the outer annular wall and depends downwardly from the top portion of the plug body.

It is envisaged that the inner annular wall 55 serves to center the plug 50 relative to the neck when the plug is placed thereon. In view thereof the wall 55 extends downward beyond the outer annular wall 52 such that the wall is introduced into the neck prior to the seal bead 54 engaging the neck. To enhance the introduction into the neck the inner annular wall has a bevelled lower edge on the outside. A further bevelled edge is present on the inside to enhance placement over the plug retention member 210. In a possible design the bevel on the outside is much greater than the bevel on the inside, e.g. increased chamfer, so as to improve placement of the plug 50 on the neck. The length of the wall 55 may also be varied, e.g. increased, relative to the depicted example.

The inner annular wall 55 frictionally engages the interior surface of the neck when the plug is mounted over the top end of the neck. As can be seen the inner and outer annular wall of the plug body define an open bottomed annular groove between them in which the top end of the neck is received when the plug is mounted over the top end of the neck.

In the depicted embodiment the exterior of the wall 55 is provided with alternating ribs 56 and grooves, extending in axial direction, with the ribs 56 frictionally engaging the neck of the spout body. The ribs are bevelled at their lower end enhancing introduction into the neck of the spout.

The top portion of the plug body is embodied with a top wall 57 of which the outer perimeter forms a peripheral and radially extending upper shoulder 58 as the top portion forms a peripheral groove 59 below said upper shoulder 58.

In more detail, in this example, the top wall 57 is joined directly to wall 60 forming an extension of the inner annular wall 55. A circular flange 61 below the groove 59 also forms part of the top portion of the plug. The outer annular wall 52 adjoins at the top end thereof the outer perimeter of this flange 61.

As can be seen in FIG. 2 it is envisaged that a single peripheral groove 59 extends around the top portion and that this groove also serves to couple the plug 50 to a plug removal and replacement device 200 of the filling machine.

As will be explained below it is envisaged that the upper shoulder 58 not only serves to bound the groove 59, but also acts as a snap-fit formation by means of which the plug body is coupled to the cap 70. It will be explained that one or more snap-fit formations of the cap extend into this peripheral groove and engage underneath the upper shoulder 58 of the plug body.

With reference to FIGS. 13-17 details of the cap 70 as well as of the snap fit cooperation thereof with the plug 50 will be discussed.

The cap has a monolithic cap body that is injection molded of thermoplastic material.

The cap body comprises a top wall 71 with an outer perimeter 72. An annular skirt 73 depends downward from the outer perimeter. At the lower end the cap is provided, integrally molded below the skirt, with a tamper-evident structure that allows to visually evidence the first time opening of the filled pouch.

The cap body is provided with one or more windows 74 in the skirt 73. Here two windows 74 at diametrically opposed positions directly below the top wall 71. As is preferred a window 74 is embodied as an elongated slot in circumferential direction of the skirt 73.

The annular skirt 73 has an interior surface 75 that delimits the inner cavity of the cap 70. In an upper region thereof the cap 50 is received. Below the cap receiving region of the bore a section of the interior surface of the cap 70 is provided with an integrally molded second cap connector formation, here embodied as a thread 76.

In the cap receiving region the interior surface 75 of the cap body is provided with an integrally molded snap-fit formation 78 that is adapted to couple with the plug 50 in a snap-fit engagement when the cap 70 is pressed over the plug 50 that is secured over the neck of the spout.

In this example the snap-fit formation 78 is embodied as an inwardly protruding peripheral snap-fit ledge 78, as is preferred directly beneath the one or more windows 74, here the one or more elongated slot windows 74.

As can be best seen in FIG. 18 the snap-fit formation 78 is adapted to snap into the groove in the top portion of the plug 50 and to engage underneath the upper shoulder 58 of the plug 50. This snap-fit is such that the coupling remains intact when the user opens the spouted pouch.

As can be seen, as preferred, the inner diameter of the plug receiving region of the bore of the cap 70 is such that the outer annular wall 52 of the plug 50 fits is received therein with a radial play, so that the sealing function thereof is not impaired by the assembly of the cap 70 over the plug 50.

As can be seen the engagement of the snap-fit formations 78, 58 between the cap and the plug is remote from outer annular wall of the plug, so that the sealing function thereof is not impaired by the assembly of the cap 70 over the plug 50.

As can be seen, the inner diameter of the threaded section of the cap 70 is greater than the outer diameter of the plug 50, such that the cap 70 can be lowered over the plug without the threading of the cap unduly interfering with the plug.

As can be seen, and as preferred, the top wall 71 of the cap covers the entirety of the top face of the plug 50, so that no access is available to the plug from above.

FIG. 18 also illustrates that the outer diameter of the outer annular wall 52 of the plug body is less than the minor diameter of the thread 28 on the tubular neck 22. In particular the neck comprises a conical portion on which the threading is located, at least part thereof.

The cap body also comprises a vertical panel 79 extending in a vertical center plane of the cap body and extending over the top wall 71 and along the exterior of the skirt 73. This panel, which may carry integrally molded indicia, effectively strengthens the cap body and enhances grip by the user. As can be gathered from FIG. 18 this strengthening may be of advantage in view of the snap-fit between the cap and the plug body.

FIG. 18 also illustrates that the seal between the seal bead 54 of the plug 50 on the exterior of the neck of the spout effectively is the only seal in the completely assembled closure between the interior of the pouch and the atmosphere. If desired one or more additional seals may be established between the plug and the neck, e.g. between the top end of the neck and the plug and/or between the interior surface of the neck and the inner annular wall of the plug. However, as discussed, the provision of a single seal around the exterior of the neck is deemed effective and reliable.

In the embodiment depicted herein the tamper-evident structure on the cap body and the mating tamper-evident formations on the spout body are embodied as disclosed in WO2014007612 which is incorporated herein by reference. The design of the tamper-evident is briefly discussed below, as detailed information is present in the mentioned prior art document.

The cap body 70 comprises a tamper-evident ring 80 that is integrally molded to the skirt 73. The tamper-evident ring is composed of two ring segments, each ring segment having a base portion and an indicator portion 81. The indicator portion 81 is connected at the head end thereof via an integrally molded frangible bridge 82 to an adjacent trailing end of a base portion of another ring segment. The spout 20, here on the top face of each portion of the upper flange 29, has for each ring segment 31 of the tamper-evident ring a rotation preventing boss 33, 34. This boss 33, 34 is arranged to be engaged by a corresponding head end of an indicator portion 81 of the segment. Upon rotating the cap 70 in opening direction by the user from its closed position for the first time, the head end of the indicator portion 81 engages the boss 33, 34 which then prevents the head end from further motion in opening direction of the cap. This cause the breaking of the frangible bridge 82 and the indicator portion 81 is subjected to permanent deformation.

In more detail the boss 33, 34 has a catch portion with a recess at a side of the boss facing the head end of the indicator portion 81 and has an catch portion outer wall with an outer face that is arranged along the inner face of the base portion near the trailing end thereof when said cap is in its closed position. The head end of the indicator portion 81 is arranged at a spacing radially inward from the trailing end of the adjacent base portion when said cap is in its closed position, such that—upon rotating the cap in opening direction by the user from its closed position for the first time—the head end of the indicator portion 81 enters the recess of the catch portion and is then prevented from further motion in opening direction of the cap, whilst the catch portion outer wall comes in the spacing between the spaced apart head end and trailing end, the frangible bridge 82 between said head end and trailing end breaking and the indicator portion 81 bending, folding, and/or buckling whilst being subjected to permanent deformation upon further rotation of the cap in opening direction.

It will be appreciated that the depicted tamper-evident is just one preferred example and many other designs of tamper-evident are possible. Preferably the tamper-evident is such that all parts thereof that are integrally molded with the cap, remain part of the cap and are not retained on the spout.

As is preferred the tamper-evident is such that the plug remains in sealing contact with the neck of the spout at least until the tamper-evident has broken one or more of its frangible bridges. This guarantees that it is impossible to, e.g. inadvertently, manipulate the cap so as to render the seal ineffective without the tamper-evident providing visible proof thereof.

It will be appreciated that for consumer products the presence of a tamper-evident is of importance to allow the consumer to check the integrity of the closure of the pouch. As discussed the inventive approach offers the advantage that, even for aseptically packaged products, there is no need for the cap to be subjected to a sterilizing treatment.

FIGS. 19, 20 illustrate the situation when the cap has been assembled. In practice the cap 70 will be pressed down over the plug and then further down with the threads between the cap and the spout engaging. The latter will require suitable design of the threads which is known in the art. The pressing down also causes the tamper-evident structure of the cap to be correctly positioned relative to the corresponding formations 35 of the spout.

As can be seen in FIG. 19 the plug 50 is visible in the windows 74 of the cap 70. This allows for easy checking of the presence of the plug and the correct mounting thereof. Also it allows to create a visual effect, e.g. if the cap and plug have different colors.

As the plug remains in the cap upon opening the pouch, the user will hardly or not realize the presence of the plug and use the assembly as if it were a normal cap. The user can also screw the cap, with the plug retained therein, back onto the neck of the spout in order to close the pouch again. The plug 50 will then again perform the sealing function as discussed herein.

As discussed above it is preferred for the interference fit plug to be provided with an outer annular wall, of which the interior surface forms an annular sealing surface that hermetically seals onto a corresponding sealing surface on the exterior of the neck of the spout.

FIGS. 21, 22 illustrate an alternative embodiment of a spout, plug, and cap for use with the inventive method. Herein the same or similar parts or portions are denoted with the same reference numeral provided with an apostrophe.

The interference fit plastic plug 50' here has an inner annular sealing wall 63 that hermetically seals onto a corresponding sealing surface in the interior of the neck 22' of the spout 20'. An outer annular wall is absent in the plug 50'.

The top portion of the plug 50' has a peripheral shoulder 64 that abuts against the top end of the neck of the spout when the spout is closed. The top portion has a diameter at most equal to the diameter of the top section of the neck or smaller.

As can be seen the plug 50 is connected to the cap 70' by means of snap-fit formations 78' and 58'. The plug 50', as is preferred, also has a groove 59', e.g. allowing for engagement with a plug removal and replacement device 200.

FIG. 23 illustrates yet another embodiment a spout, plug, and cap for use with the inventive method. Herein the same or similar parts or portions are denoted with the same reference numeral provided with a double apostrophe.

The interference fit plastic plug 50" here has an inner annular sealing wall 63" that hermetically seals onto a corresponding sealing surface in the interior of the neck 22' of the spout 20'. An outer annular wall is absent in the plug 50'.

The top portion of the plug 50" has a peripheral shoulder 64 that abuts against the top end of the neck of the spout when the spout is closed. The top portion has a diameter at most equal to the diameter of the top section of the neck or smaller.

As can be seen the plug 50" is connected to the cap 70" by means of snap-fit formations 78" and 58". The top portion of the plug 50", as is preferred, also has a groove 59", e.g. allowing for engagement with a plug removal and replacement device 200.

As can be seen the plug body comprises a dome portion 65 or the like which adjoins the lower end of the inner annular wall 63'. The dome portion is directed deeper into the neck of the spout when the plug is placed in the neck.

FIG. 24 is a flow diagram illustrating an embodiment of the inventive method for aseptically packaging a flowable product in spouted pouches.

First block 300 represents the manufacturing of pouch bodies 10 and the provision thereof with spouts as well as plugs 50 that seal the still empty spouted pouches. Preferably the closed spouted pouches are placed on transport rails, e.g. with the flanges of the C-shaped rails engaging between the flanges of the spout.

Second block 301 represents that the empty spouted pouches, sealed by the plugs 50, are subjected to a pre-sterilizing treatment, e.g. by irradiation. Preferably the spouted pouches are received on transport rails in this stage, e.g. many rails filled with pouches packaged in a transport envelope, e.g. a box and/or plastic bag.

Outline 302 very schematically represent a filling machine, and outline 303 very schematically represents an aseptic environment within said filling machine, e.g. formed by a chamber wherein a positive gas flow of sterilized gas is maintained. As discussed it is possible that the entire pouch passes through this zone. In another embodiment, only the region of the plug and the spout, or part of the spout, pass through the aseptic zone.

As discussed the spouted pouches could be passed through a sterilant vapour chamber or tunnel, e.g. with hydrogen peroxide, to sterilize all exterior surfaces prior to entry into the aseptic chamber where the plug is removed, the pouch is filled, and the plug replaced.

Third block 304 represent, within the aseptic environment, the removal of the plug 50 from the neck, e.g. by simple lifting action as is preferred. As discussed it is preferred for the plug to be temporarily retained by a dedicated retaining member within said aseptic environment.

Fourth block 305 represents, within the aseptic environment, the filling of the opened pouch, e.g. by the filling nozzle 210.

Fifth block 306 represents, within the aseptic environment, the replacement of the plug onto the neck. As discussed the seal bead 54 guarantees the sealing of the filled pouch.

Outline 307 very schematically represents a capping machine, which is located outside the aseptic environment. As is preferred the capping machine is directly downstream of the filling machine. In an embodiment the capping machine and filling machine share a common frame so are embodied as an integrated filling and capping machine.

Sixth block 308 represents the assembly of the cap 70, wherein the cap 70 is suitably lowered over the plug and further down over the spout 20. As discussed in this capping process the cap snap-fits onto the plug 50 and the threads or other cap connector formations on the cap and the spout engage. Also, in the same process, the tamper-evident structure of the cap is positioned relative to mating formations on the spout.

Seventh block 309 represents the discharge of filled and capped pouches, ready for sale to consumers.

The invention claimed is:

1. In combination a spouted pouch adapted to be filled with a flowable product by a filling machine, a plug, and a cap, comprising:

a flexible material pouch body, a spout having a molded spout body of plastic material, said spout body having at a lower end thereof an attachment portion that is attached to the pouch body, wherein said spout body has at an upper end thereof a tubular neck, the tubular neck having an interior surface delimiting at least a section of a product passage that extends from a lower product passage opening through the spout body to a mouth opening at a top end of the tubular neck, said tubular neck also having an exterior surface, an interference-fit plug, wherein the interference-fit plug is releasably mounted over the top end of the tubular neck of the spout body in an interference fit and hermetically seals the product passage of the spout body, the interference-fit plug having a molded plug body of plastic material, wherein the plug body has a top portion and a downward depending outer annular wall adapted to be fitted over a top section of the tubular neck of the spout, wherein the outer annular wall has an interior surface which forms an annular sealing surface, wherein the exterior surface of the top section of the tubular neck embodies a cooperating annular sealing surface such that a hermetic seal is present between the outer annular wall of the interference-fit plug and the tubular neck of the spout body, wherein the exterior of the tubular neck of the spout body, below the top section thereof, is provided with an integrally molded first cap connector formation, wherein the interference-fit plug is adapted to be removed by the filling machine and to be replaced by pressing the interference-fit plug onto the tubular neck after filling of the pouch with the flowable product, wherein said combination further includes a manually openable cap that is adapted to be assembled on the spouted pouch after the filling of the pouch and the replacing of the interference-fit plug onto the tubular neck, wherein the cap has a cap body that is injection molded of thermoplastic material, the cap body including an annular skirt having an interior surface, an exterior surface, and a lower end, wherein a section of the interior of the annular skirt is provided with an integrally molded second cap connector formation (76) that is adapted to cooperate with the first cap connector formation on the tubular neck of the spout body, and wherein the cap body and the plug body are provided with cooperating snap-fit formations, wherein the cap body and the plug body are structurally configured such that, with the interference-fit plug replaced over the top end of the tubular neck, the cap body is lowerable over the interference-fit plug in a manner causing the first and second cap connector formations to cooperate and causing the snap-fit formations to engage and thereby couple the interference-fit plug to the cap, wherein the cooperating snap fit formations coupling the interference-fit plug to the cap are such that upon manually opening of the cap the interference-fit plug remains coupled to the cap and is entrained with the cap so as to open the product passage and allowing dispensing of the flowable product from the spouted pouch, and wherein the cap, below the annular skirt, is provided with an integrally molded tamper-evident structure that allows visual evidence of a first time opening of the spouted pouch, and wherein the spout body, below the first cap connector formation, is provided with one or more integrally molded tamper-evident formations that cooperate with said tamper-evident structure of the cap, such that upon first time opening of the spouted pouch the tamper-evident structure evidences said first time opening.

2. The combination of claim 1, wherein the plug body (50) comprises one or more centering portions downwardly depending from the top portion of the plug body and frictionally engaging the interior surface of the tubular neck when the interference-fit plug is mounted over the top end of the tubular neck.

3. The combination of claim 2, wherein the centering portion of the plug body comprises an inner annular wall downwardly depending from the top portion of the plug body and coaxial with the outer annular wall, wherein the inner annular wall frictionally engages the interior surface of the tubular neck when the interference-fit plug is mounted over the top end of the tubular neck, wherein the inner and outer annular walls of the plug body define an open bottomed annular groove between them in which the top end of the tubular neck is received when the interference-fit plug is mounted over the top end of the tubular neck.

4. The combination of claim 2, wherein the one or more centering portions extend downward beyond the outer annular wall, said one or more centering portions having a bevelled lower edge to facilitate introduction of the one or more centering portions into the tubular neck of the spout body.

5. The combination of claim 1, wherein the top portion of the plug body is provided with a peripheral groove extending around the top portion.

6. The combination of claim 1, wherein each snap-fit formation of the plug body is embodied by the top portion of the plug body.

7. The combination of claim 1, wherein the top portion of the plug body is provided with a peripheral groove extending around the top portion, wherein an upper shoulder of the plug body delimits the top of the peripheral groove, and wherein one or more snap-fit formations of the cap extend into said peripheral groove and engage underneath said upper shoulder of the plug body.

8. The combination of a claim 1, wherein the first and second cap connector formations are integrally molded threads, and wherein the outer diameter of the outer annular wall of the plug body is less than a minor diameter of the thread on the tubular neck.

9. The combination of claim 1, wherein the cap body comprises one or more windows that display one or more sections of the plug body when coupled to the cap body.

10. The combination of claim 1, wherein the spout body comprises a pair of upper and lower flanges (29,20) extending around the tubular neck, below said first cap connector formation, and wherein the annular skirt is dimensioned such that the lower end of the tamper evident structure of the cap body is located directly above the upper flange when the cap is assembled on the spouted pouch.

11. The combination of claim 1, wherein the cap body comprises a top wall an outer perimeter, and wherein said annular skirt depends downward from said outer perimeter, wherein the cap body is provided with one or more windows, in said annular skirt directly below said top wall, wherein the interior of the annular skirt comprises a peripheral snap-fit ledge protruding inward, said ledge engaging beneath a peripheral shoulder of the cap body.

12. The combination of claim 1, wherein the cap body comprises a top wall with an outer perimeter, and wherein said annular skirt depends downward from said outer perimeter, and wherein the cap body comprises a vertical panel extending in a vertical center plane of the cap body and extending over said top wall and along the exterior of the annular skirt, thereby strengthening the cap body and enhancing grip by the user.

13. In combination an interference-fit plug and a cap adapted to be assembled on a tubular neck of a flowable product container, wherein said combination comprises:

wherein the interference-fit plug is adapted to be releasably mounted over a top end of the tubular neck of a flowable product container in an interference fit and to hermetical seal a product passage through said tubular neck, the interference-fit plug having a molded plug body of plastic material, wherein the plug body has a top portion and a downward depending outer annular wall adapted to be fitted over a top section of the tubular neck, wherein the outer annular wall has an interior surface which embodies an annular sealing surface that is adapted to cooperate with an annular sealing surface on an exterior surface of a top section of the tubular neck such that a hermetic seal is present between the outer annular wall of the interference-fit plug and the tubular neck, wherein the interference-fit plug is adapted to be removed by a filling machine and to be replaced by pressing the interference-fit plug onto the tubular neck after filling of the flowable product container with a flowable product, wherein said combination further comprises:

a manually openable cap that is adapted to be assembled on the flowable product container after the filling of the flowable product container and the replacing of the interference-fit plug onto the neck, wherein the cap has a cap body that is injection molded of thermoplastic material, the cap body including an annular skirt having an interior surface, an exterior surface, and a lower end, wherein a section of the interior of the annular skirt is provided with an integrally molded second cap connector formation that is adapted to cooperate with a first cap connector formation on the exterior of the tubular neck below the top section thereof, and wherein the cap body and the plug body are provided with cooperating snap-fit formations, wherein the cap body and the plug body are embodied such that, with the interference-fit plug replaced over the top end of the tubular neck, the cap body can be lowered over the interference-fit plug in an manner causing the first and second cap connector formations to cooperate and causing the snap-fit formations to engage and thereby couple the interference-fit plug to the cap, wherein the cooperating snap fit formations coupling the interference-fit plug to the cap are such that upon manually opening of the cap the interference-fit plug remains coupled to the cap and is entrained with the cap so as to open the product passage and allowing dispensing of the flowable product from the flowable product container, and wherein the cap, below the annular skirt, is provided with an integrally molded tamper-evident structure that allows visual evidence of a first time opening of the flowable product container.

* * * * *